US010172476B2

(12) United States Patent
Bellows et al.

(10) Patent No.: US 10,172,476 B2
(45) Date of Patent: Jan. 8, 2019

(54) CHILD BOOSTER SEAT

(71) Applicants: William B. Bellows, Wyomissing, PA (US); Jonathan M. Pacella, Coatesville, PA (US); Andrew J. Winterhalter, West Lawn, PA (US); Nathanael Saint, Morgantown, PA (US)

(72) Inventors: William B. Bellows, Wyomissing, PA (US); Jonathan M. Pacella, Coatesville, PA (US); Andrew J. Winterhalter, West Lawn, PA (US); Nathanael Saint, Morgantown, PA (US)

(73) Assignee: Wonderland Switzerland AG, Steinhausen (CH)

( * ) Notice: Subject to any disclaimer, the term of this patent is extended or adjusted under 35 U.S.C. 154(b) by 107 days.

(21) Appl. No.: 15/272,445

(22) Filed: Sep. 22, 2016

(65) Prior Publication Data

US 2017/0079446 A1 Mar. 23, 2017

Related U.S. Application Data

(60) Provisional application No. 62/221,876, filed on Sep. 22, 2015.

(51) Int. Cl.
*A47D 1/10* (2006.01)
*A47C 1/02* (2006.01)

(52) U.S. Cl.
CPC ..... *A47D 1/103* (2013.01); *A47C 1/02* (2013.01)

(58) Field of Classification Search
CPC ..... A47D 1/002; A47D 1/004; A47D 1/008; A47D 1/02; A47D 1/103; B60N 2/2806; B60N 2/286; B60N 2/2821; B60N 2/28
See application file for complete search history.

(56) References Cited

U.S. PATENT DOCUMENTS 1,739,366 A * 12/1929 Lang ..... A47D 1/103 297/153
1,967,533 A * 7/1934 Koop ..... A47D 1/02 297/183.5
4,336,636 A * 6/1982 Ishiguro ..... F16G 11/101 24/115 M
5,183,311 A * 2/1993 Meeker ..... A47D 1/004 297/151
6,305,299 B1 * 10/2001 Ragland ..... B60N 3/002 108/44
6,592,183 B2 * 7/2003 Kain ..... B60N 2/2806 297/250.1

(Continued)

*Primary Examiner* — James M Ference
(74) *Attorney, Agent, or Firm* — Winston Hsu

(57) ABSTRACT

A child booster seat includes a base, a flexible connecting member, two attachment parts, and a mechanism. The base has a seat plate for a child sitting thereon. The flexible connecting member is attached to the base. The attachment parts are attached to two ends of the flexible connecting member. The mechanism is disposed on the base for tensing the flexible connecting member. When the child booster seat is secured on a chair through the two attachment parts, the mechanism is operated to tense the flexible connecting member, so that the child booster seat is secured firmly and it is hard to move the child booster seat relative to the adult chair.

10 Claims, 29 Drawing Sheets

(56) References Cited

U.S. PATENT DOCUMENTS 6,672,664 B2 * 1/2004 Yanaka ..... B60N 2/2806 24/134 KB
6,773,064 B2 8/2004 Treen
6,832,813 B2 12/2004 Tomas
6,863,345 B2 * 3/2005 Kain ..... B60N 2/2806 297/250.1
7,159,948 B1 * 1/2007 Wolf ..... B60N 2/2806 297/253
7,168,762 B2 * 1/2007 Maciejczyk ..... B60N 2/2806 297/250.1
7,300,103 B1 * 11/2007 Grays ..... A47D 1/008 108/90
7,328,941 B2 2/2008 Asbach
7,673,940 B2 * 3/2010 Fritz ..... A47D 1/004 297/250.1
7,854,476 B1 * 12/2010 Liu ..... A47D 1/103 297/181
8,091,965 B2 * 1/2012 Flannery ..... A47D 1/103 297/250.1
8,172,322 B2 * 5/2012 Chen ..... B62B 7/123 297/250.1
8,801,097 B2 * 8/2014 Gaudreau, Jr. ..... B60N 3/101 297/253
9,150,126 B1 * 10/2015 Kitchens ..... B60N 2/2806
9,308,838 B2 * 4/2016 Miller ..... B60N 2/2821
2002/0167214 A1 * 11/2002 Nelson ..... A47D 1/103 297/485
2007/0284924 A1 * 12/2007 Gold ..... B60N 2/2821 297/253
2009/0026815 A1 * 1/2009 Amesar ..... B60N 2/2809 297/216.11
2009/0066131 A1 * 3/2009 Hendry ..... B60N 2/2806 297/256.16
2010/0033001 A1 * 2/2010 Boyer ..... B60N 2/2806 297/253
2010/0253121 A1 * 10/2010 Buckingham ..... B60N 2/2806 297/253
2011/0140491 A1 * 6/2011 Williams ..... B60N 2/2806 297/256.16
2012/0007398 A1 * 1/2012 Fritz ..... B60N 2/2806 297/253
2012/0261958 A1 * 10/2012 Hutchinson ..... B60N 2/2806 297/250.1
2013/0119732 A1 * 5/2013 Wuerstl ..... B60N 2/2806 297/253
2013/0127218 A1 * 5/2013 Carpenter ..... B60N 2/2821 297/253
2013/0300169 A1 * 11/2013 Lu ..... A47D 1/103 297/250.1
2014/0062151 A1 * 3/2014 Banghart ..... B60N 2/2863 297/253
2014/0085070 A1 * 3/2014 Schoenberg ..... B60R 22/48 340/457.1
2014/0252841 A1 * 9/2014 Balensiefer, II ..... B60N 2/2812 297/471
2014/0292503 A1 * 10/2014 Schoenberg ..... B60R 21/01556 340/438
2014/0368004 A1 * 12/2014 Sclare ..... A47D 1/10 297/135
2015/0251567 A1 * 9/2015 Cohen ..... B60N 2/2806 297/256.15

* cited by examiner

CHILD BOOSTER SEAT

CROSS REFERENCE TO RELATED APPLICATIONS

This application claims the benefit of U.S. Provisional Application No. 62/221,876 filed on Sep. 22, 2015 is incorporated herein by reference.

BACKGROUND OF THE INVENTION

1. Field of the Invention

The invention relates to a booster seat, and especially relates to a child booster seat capable of being attached to a chair.

2. Description of the Prior Art

In order for caregivers to feed their children, a number of products are employed. High chairs provide a means for the caregiver to place her child for feeding. The high chairs typically afford a number of convenience features such as recline, height-adjustment, removable tray and the like. However, even though some high chairs are foldable for storage, they are often bulky and take up valuable space in the kitchen or dining area. If the caregiver has little space for a high chair, a feeding booster seat (or booster) is oftentimes an effective alternative. There are several boosters on the market that have many similar features that high chairs do but do not take up anymore space than an adult kitchen or dining chair. Most of these boosters require the caregiver to secure it to an adult chair prior to use for extra security or stability. They are usually equipped with straps for being attached onto an adult chair. When the booster is attached onto an adult chair, the straps are connected through a buckle around either the seat bottom or seat back of the adult chair. The caregiver can tighten the straps through the buckle for securing the booster on the adult chair. However, in fact, it is difficult to adjust the straps tight enough onto the adult chair in order to prevent it from sliding back-and-forth or side-to-side. Furthermore, there is a high possibility of misuse of the straps. For example, the caregiver may connect the straps around either the seat bottom or seat back but not tighten the straps securely, which may lead to a potentially hazardous condition. In addition, the straps may need to be managed for convenient storage. It would be annoying to have the straps just dangling, especially while the caregiver tries to move the booster around or store it.

SUMMARY OF THE INVENTION

An objective of the invention is to provide a child booster seat, which uses a mechanism for tensing a flexible connecting member by which the child booster seat is secured to a chair.

A child booster seat according to the invention includes abase, a flexible connecting member, a first attachment part, a second attachment part, and a mechanism. The base has a seat plate for a child sitting thereon. The flexible connecting member is attached to the base. The first attachment part is attached to one end of the flexible connecting member. The second attachment part is disposed opposite to the first attachment part and attached to another end of the flexible connecting member. The mechanism is disposed on the base for tensing the flexible connecting member. When the child booster seat is secured on a chair through the first attachment part and the second attachment part, the mechanism is operated to tense the flexible connecting member. Further, the child booster seat can include a length adjusting mechanism for adjusting an effective length of the flexible connecting member, i.e. the lengths of portions of the flexible connecting member which are involved in attaching the base onto the chair. In other words, the length adjusting mechanism can adjust the lengths of the outside portions of the flexible connecting member which are defined as being from the base to the first and second attachment parts. Furthermore, in practice, the length adjusting mechanism is also conducive to management of the flexible connecting member with the first attachment part when the caregiver tries to move the child booster seat around or store it.

Compared with the prior art, the child booster seat according to the invention can be attached firmly to the chair without sliding back-and-forth or side-to-side relative to the chair because the flexible connecting member is tightened by the mechanism and the first and second attachment parts are substantially stationary relative to the chair. Therefore, the child booster seat according to the invention can offer a firm attachment of the child booster seat to the chair, so that it is safe for the child to sit thereon.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
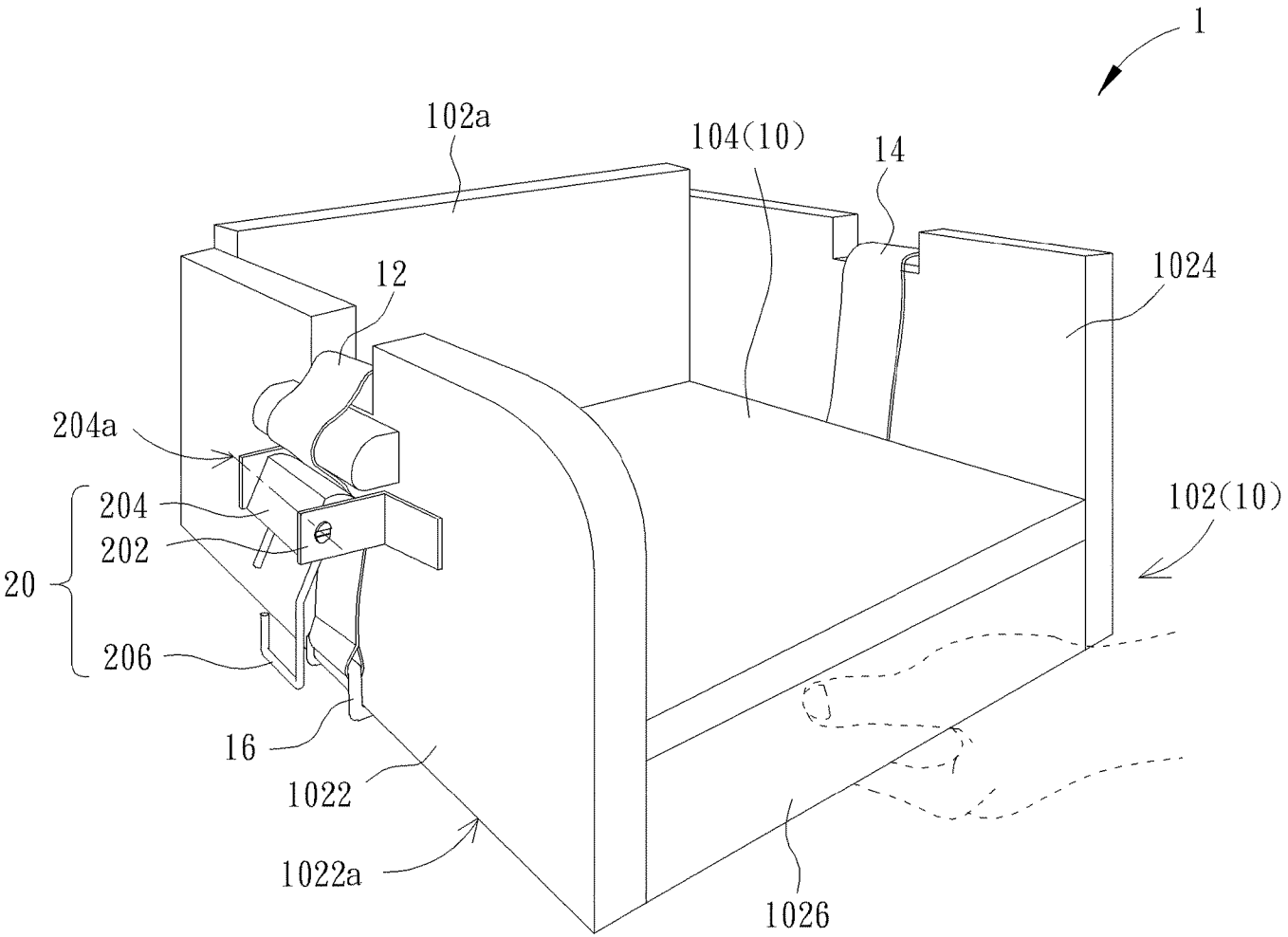
FIG. 1 is a schematic diagram illustrating a child booster seat of an embodiment according to the invention.
Figure 2:
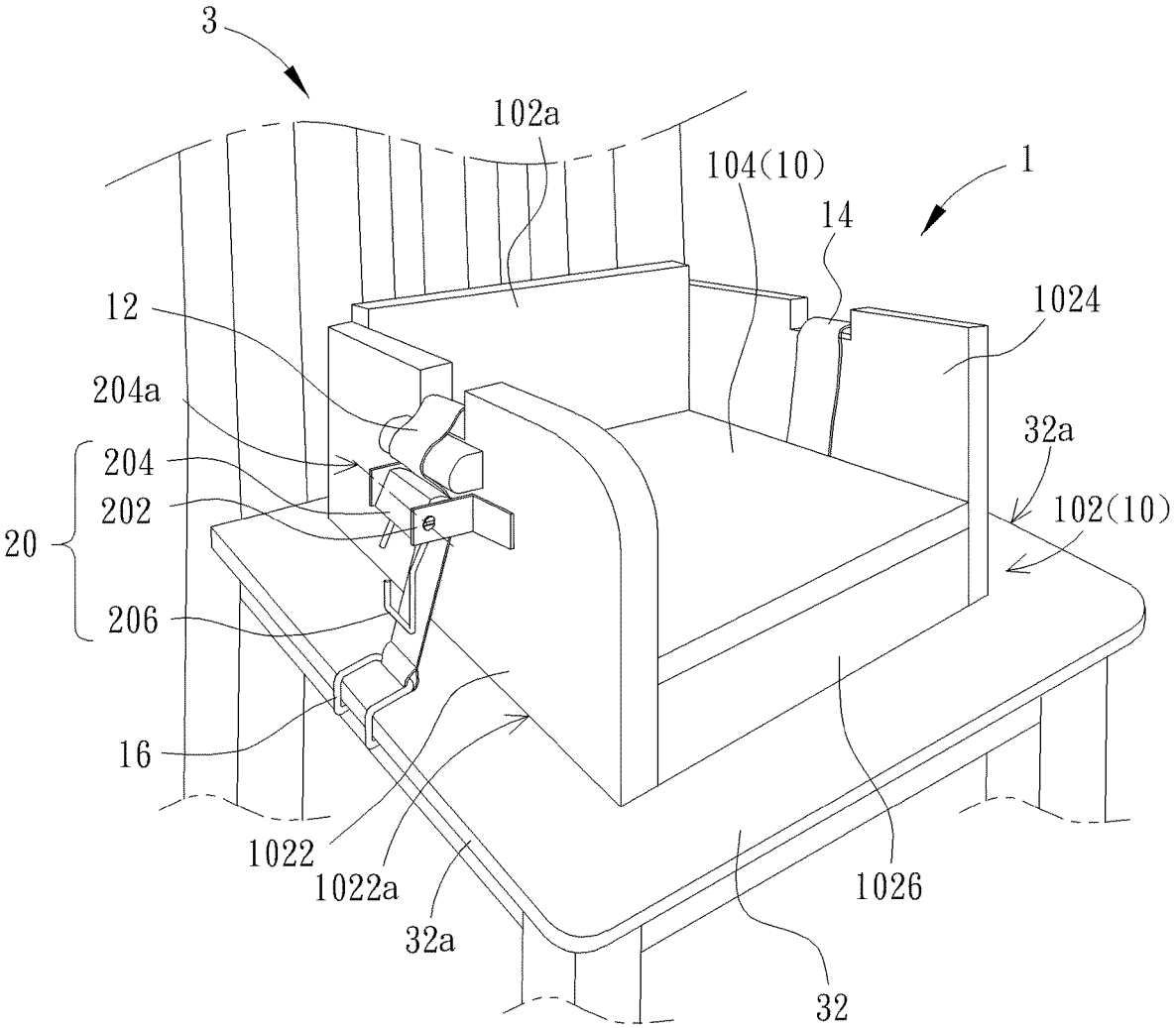
FIG. 2 is a schematic diagram illustrating the child booster seat in FIG. 1, which is secured onto an adult chair.
Figure 3:
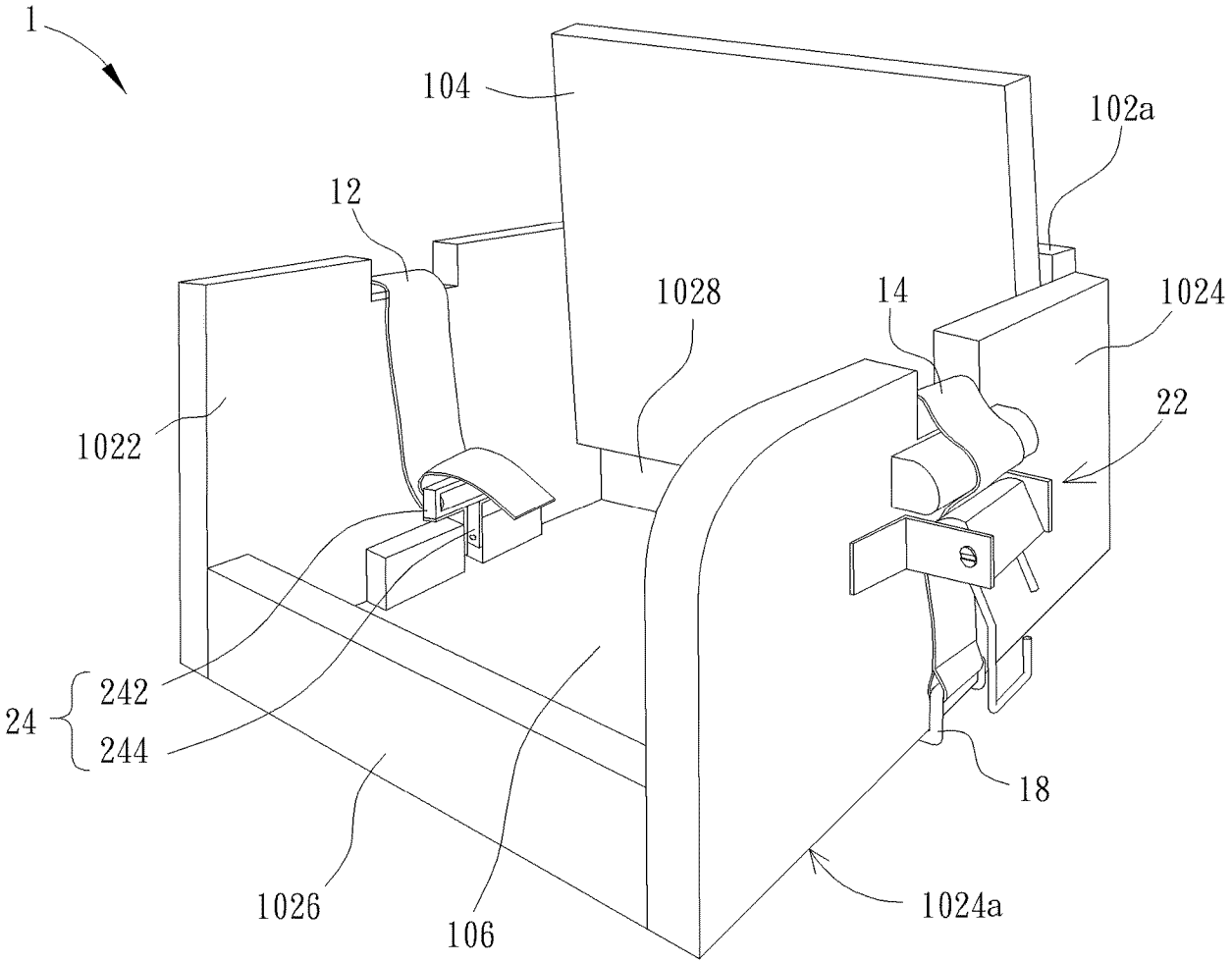
FIG. 3 is a schematic diagram illustrating the child booster seat in FIG. 1, of which a seat plate is rotated up.
Figure 4:
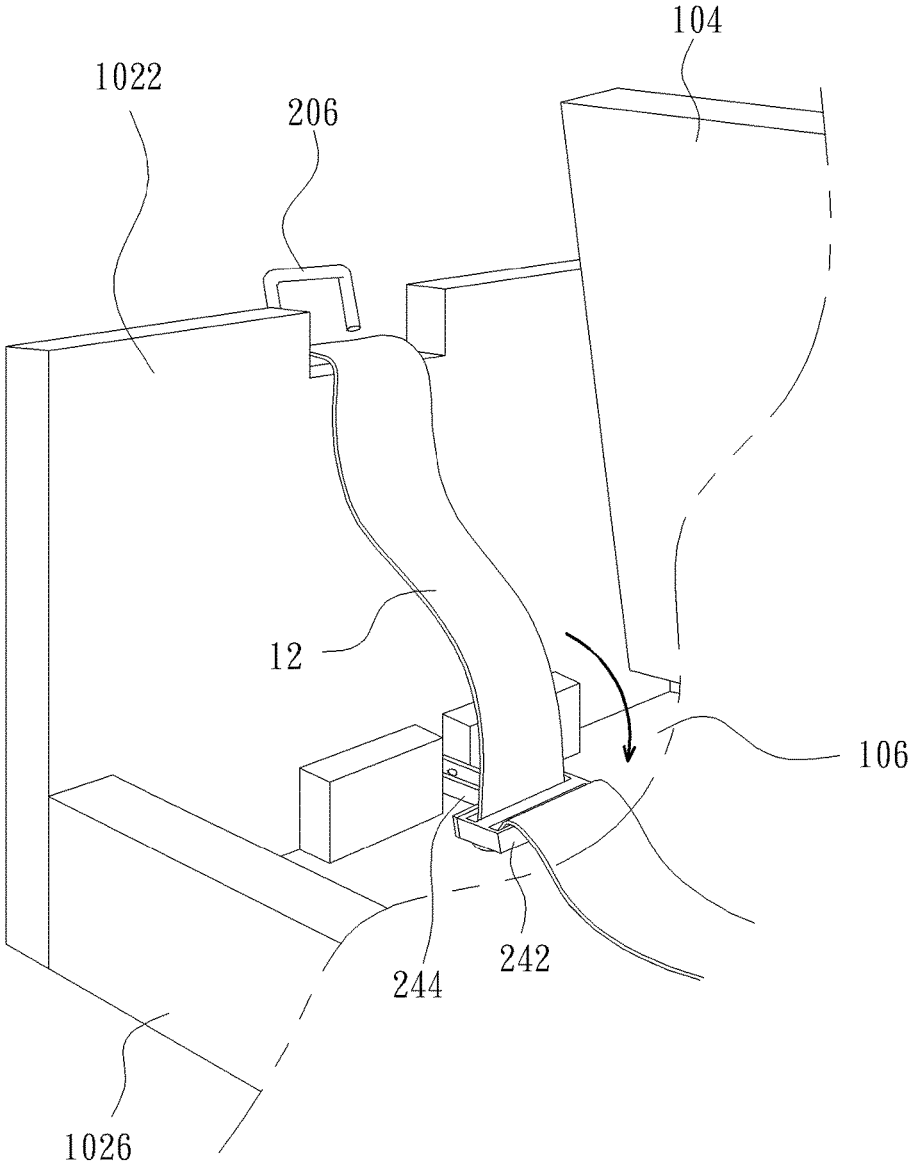
FIG. 4 is a schematic diagram illustrating a first length adjusting device of the child booster seat.

Please refer to FIG. 1 and FIG. 2. A child booster seat 1 of an embodiment according to the invention includes abase 10, a flexible connecting member (including a first flexible part 12 and a second flexible part 14), a first attachment part 16, a second attachment part 18, and a mechanism (including a first tensing mechanism 20 and a second tensing mechanism 22). The first flexible part 12 and the second flexible part 14 are attached to the base 10. The first attachment part 16 is disposed outside the base 10 and attached to one end of the first flexible part 12. The second attachment part 18 is disposed opposite to the first attachment part 16 outside the base 10 and attached to one end of the second flexible part 14. The first tensing mechanism 20 is disposed on the base 10 for tensing the first flexible part 12. The second tensing mechanism 22 is disposed on the base 10 for tensing the second flexible part 14. As shown by FIG. 2, when the child booster seat 1 is secured on an adult chair 3 e.g. an adult kitchen or dining chair, the first attachment part 16 and the second attachment part 18 are attached to opposite edges 32*a* and 32*b* of a seat plate 32 of the adult chair 3, and the first tensing mechanism 20 and the second tensing mechanism 22 are operated to tense the first flexible part 12 and the second flexible part 14 respectively. Therein, the first and second tensing mechanisms 20 and 22 increase the tensile stresses of the first and second flexible parts 12 and 14 by taking up sufficient slack of the first and second flexible parts 12 and 14 respectively, so that the first and second flexible part 12 and 14 can be tighter. Although two flexible parts and tensing mechanisms are provided in this embodiment, it should be appreciated that the child booster seat can still be secured on the adult chair by only using one flexible part and one tensing mechanism. Alternatively, in a further embodiment, one tensing mechanism may be provided to tense both the first and second flexible parts 12 and 14.

In more detail for the embodiment, the child booster seat 1 is structurally symmetric for simplification of description; therefore, the first flexible part 12, the first attachment part 16, and the first tensing mechanism 20 are identical to the second flexible part 14, the second attachment part 18, and the second tensing mechanism 22 respectively, and descriptions for the corresponding components can refer to each other. For example, description of the first flexible part 12 is also applied to the second flexible part 14, and vice versa. However, the invention is not limited thereto. Please also refer to FIG. 3 to FIG. 9. In the embodiment, the base 10 includes a bottom frame 102 and a seat plate 104 pivotally connected to the bottom frame 102, e.g. through hinges at two opposite sides of the seat plate 104. Therein, when the seat plate 104 is rotated down, there is a rear protrusive portion 102*a* of the bottom frame 102 which protrudes out the seat plate 104 and therefore can be taken as a seat back for a child sitting on the seat plate 104 to recline against. The bottom frame 102 includes a first side wall 1022, a second side wall 1024, a front side wall 1026, and a rear side wall 1028, which are connected to form a rectangle frame. The seat plate 104 is pivotally connected to the first and second side walls 1022 and 1024. When the seat plate 104 is rotated down, the seat plate 104 is also supported by the front side wall 1026 so that a child can sit thereon, and the bottom frame 102 and the seat plate 104 form an accommodating space 106. The first flexible part 12 is a flexible webbing strap. The first attachment part 16 is sewn to one end of the first flexible part 12. The first flexible part 12 passes across the first side wall 1022 and is attached to bottom frame 102 through a first length adjusting device 24 disposed on the base 10 in the accommodating space 106; therefore, the first flexible part 12 extends out the base 10 from the first side wall 1022. Similarly, the second flexible part 14 passes across the second side wall 1024 and is attached to bottom frame 102 through a second length adjusting device (not shown in the figures) disposed on the base 10 in the accommodating space 106; therefore, the second flexible part 14 extends out the base 10 from the second side wall 1024. In practice, it is practicable to use one like the first length adjusting device 24 as the second length adjusting device; however, the invention is not limited thereto.

The first length adjusting device 24 can adjust an effective length of the first flexible part 12, i.e. the length of a portion of the first flexible part 12 which is involved in attaching the base 10 onto the adult chair 3, so that the first length adjusting device 24 is operable to shorten a length of the first flexible part 12 from the first length adjusting device 24 to the first attachment part 16. The first length adjusting device 24 includes a 3-bar adjuster 242 and an adjuster support 244. The adjuster support 244 is pivotally connected to the bottom frame 102 of the base 10. The 3-bar adjuster 242 is connected to the adjuster support 244. The first flexible part 12 is woven through the 3-bar adjuster 242 so that the 3-bar adjuster 242 is operable to move relatively to the first flexible part 12 to shorten the length of the first flexible part 12 from the 3-bar adjuster 242 of the first length adjusting device 24 to the first attachment part 16. Therein, the length of the portion of the first flexible part 12 from the 3-bar adjuster 242 to the first attachment part 16 is defined as the effective length of the first flexible part 12. Furthermore, in the embodiment, the adjuster support 244 is pivotally connected to the first side wall 1022 in the accommodating space 106. The first attachment part 16 and the first length adjusting device 24 are located at two opposite sides of the first side wall 1022.

The first tensing mechanism 20 includes a cam support 202, an over-center cam 204, and a cam lever 206. The cam support 202 is fixed on the first side wall 1022 of the bottom frame 102 of the base 10. The over-center cam 204 is pivotally connected to the cam support 202 about a rotational axis 204*a* (indicated by a center line in FIG. 1). The cam lever 206 is connected to the over-center cam 204 so that the over-center cam 204 can be rotated through the cam lever 206. The first flexible part 12 passes by the over-center cam 204. The first flexible part 12 passes between the first side wall 1022 and the over-center cam 204. Because the over-center cam 204 is not axially symmetric relative to the rotational axis 204*a*, the gap between the first flexible part 12 and the rotational axis 204*a* varies as the over-center cam 204 pivots about the rotational axis 204*a*. In the embodiment, the gap between the first flexible part 12 and the rotational axis 204*a* is relatively small when the cam lever 206 is rotated up while the gap is relatively larger when the cam lever 206 is rotated down.

When the child booster seat 1 is to be secured to the adult chair 3, a user or caregiver can place the base 10 on the seat plate 32 of the adult chair 3. Then, the caregiver can make the seat plate 104 of the base 10 pivot upward for access to the accommodating space 106. After rotating the adjuster support 244 downward, the caregiver can loosen the first flexible part 12 by moving the first flexible part 12 relative to the 3-bar adjuster 242, so that the caregiver can pull the first attachment part 16 outward relative to the base 10 for increasing the length of the first flexible part 12 from the 3-bar adjuster 242 to the first attachment part 16. Therefore, the length of the outside portion of the first flexible part 12 which is from the first side wall 1022 to the first attachment part 16 increases. Then, the caregiver can attach the first attachment part 16 to the edge 32*a* of the seat plate 32. In the embodiment, the first attachment part 16 is a hook hooking the edge 32*a*. Similarly, the caregiver also can attach the second attachment part 18 to the edge 32*b* of the seat plate 32.

Figure 5:
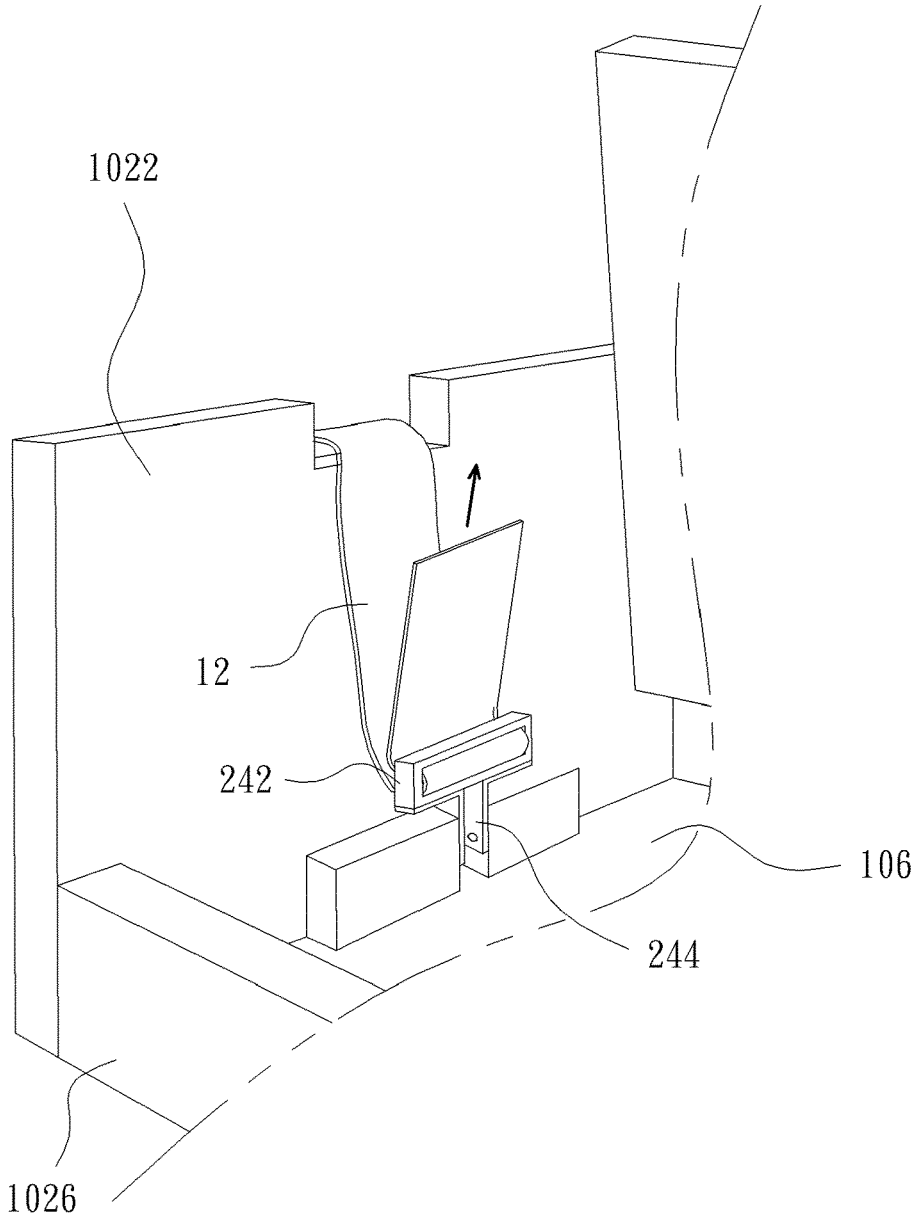
FIG. 5 is a schematic diagram illustrating how to eliminate the slack of the first flexible part through the first length adjusting device.
Figure 6:
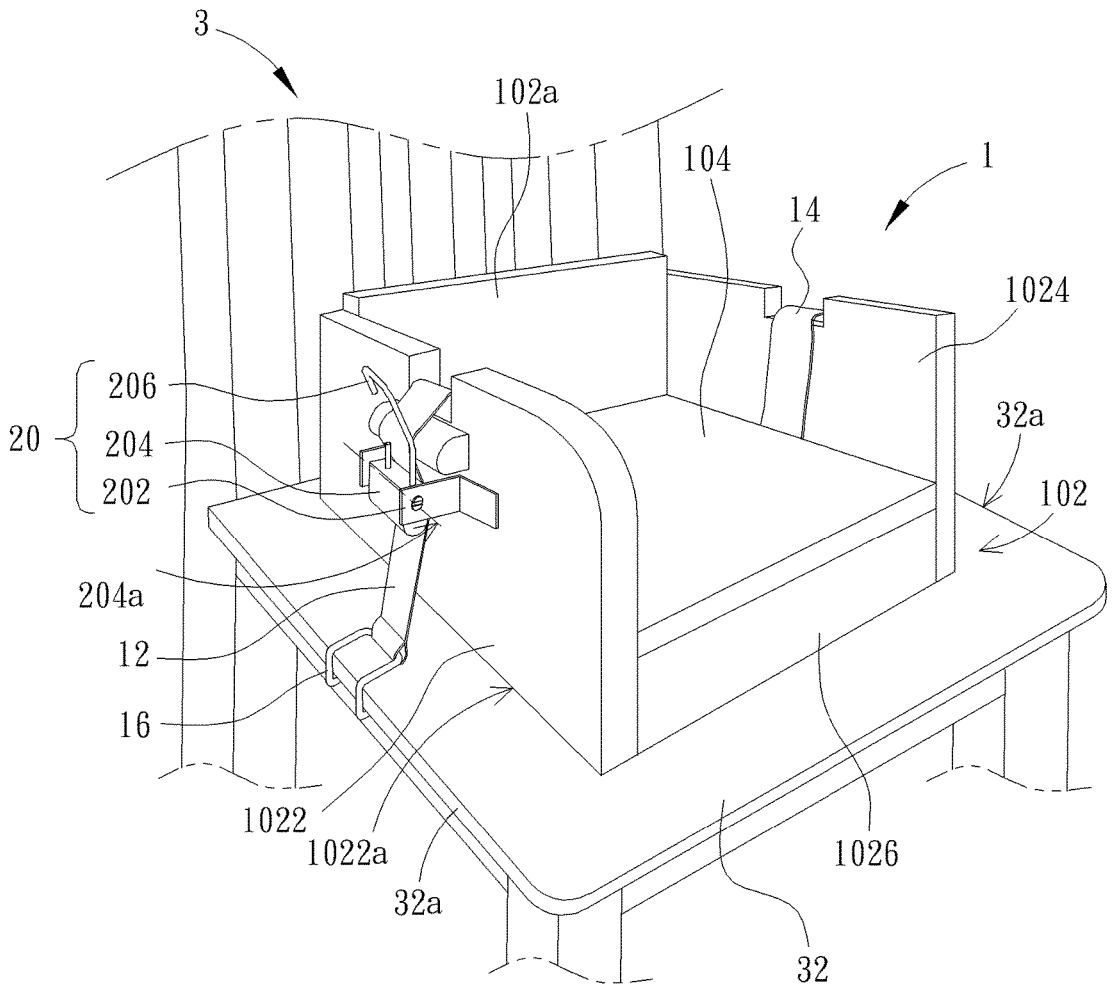
FIG. 6 is a schematic diagram illustrating the child booster seat, of which two attachment parts are attached to two opposite edges of a seat plate of the adult chair.

Afterward, the caregiver can adjust the length of the first flexible part 12 from the 3-bar adjuster 242 to the first attachment part 16 for eliminate the slack of the first flexible part 12. In practice, the caregiver can directly pull the other end of the first flexible part 12 upward, so that the adjuster support 244 pivots upward and the length of the first flexible part 12 is shortened, which can make the first flexible part 12 tight (or eliminate the slack of the first flexible part 12), as shown by FIG. 5. Therein, before shortening the first flexible part 12, the cam lever 206 has to pivot up. After the first flexible part 12 is shortened as shown by FIG. 6, the first flexible part 12 at least is not loose. After shortening the first and second flexible parts 12, the seat plate 104 can be rotated down so that the child can sit thereon.

Figure 7:
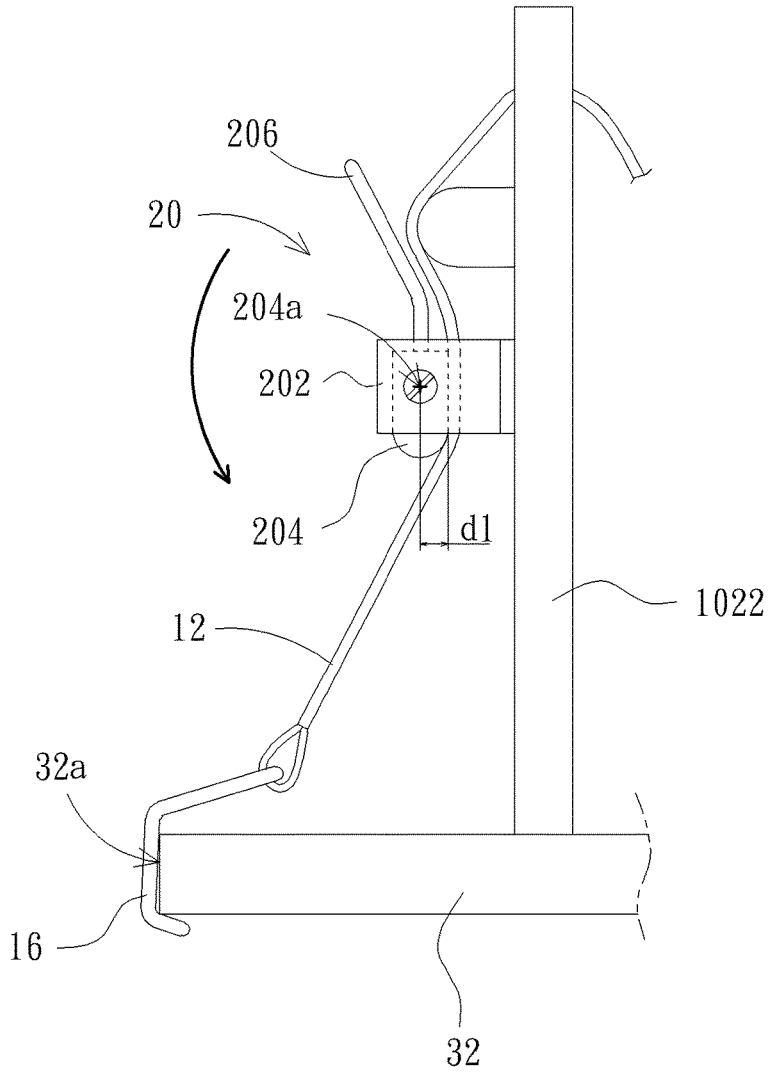
FIG. 7 is a schematic diagram illustrating an over-center cam of a first tensing mechanism of the child booster seat being located at a first position.
Figure 8:
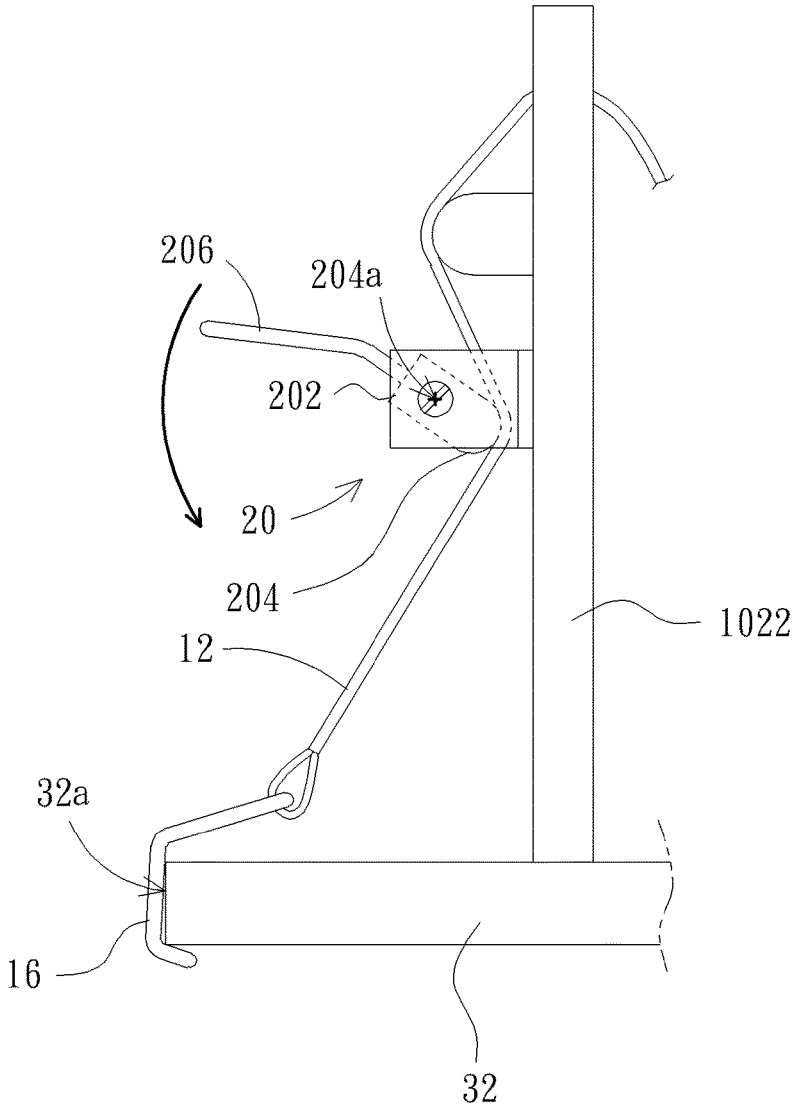
FIG. 8 is a schematic diagram illustrating the over-center cam being located at a position between the first position and a second position.
Figure 9:
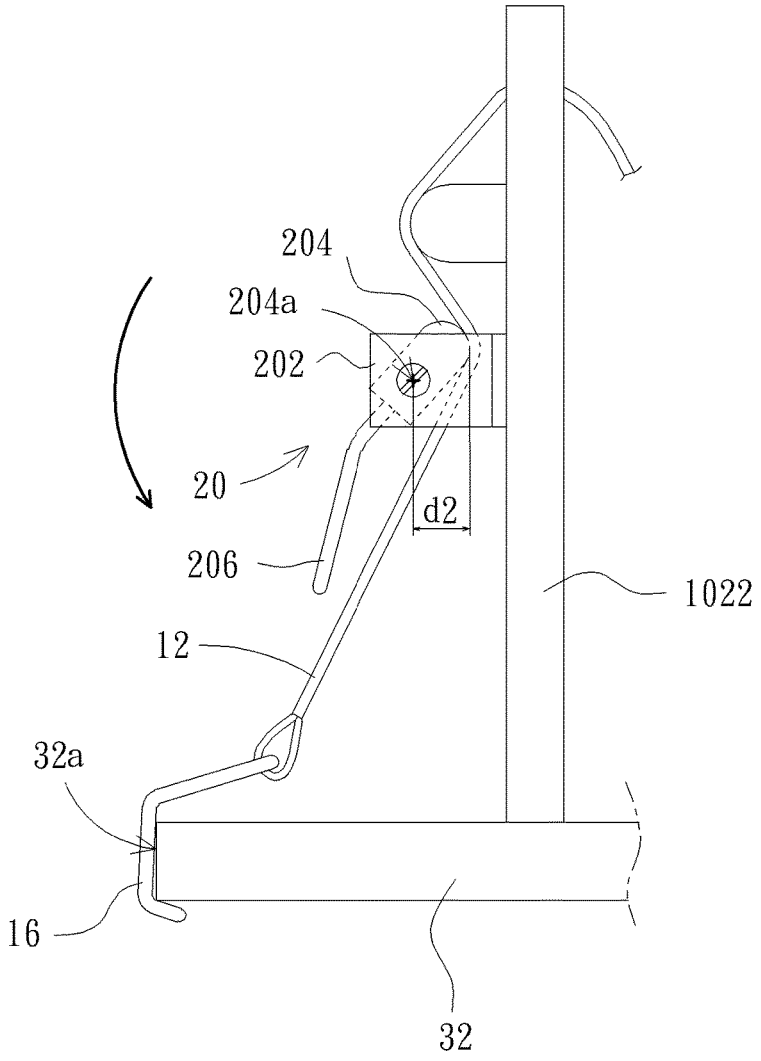
FIG. 9 is a schematic diagram illustrating the over-center cam being located at the second position.

Afterward, the caregiver can rotate the cam lever 206 down, as shown by FIG. 7 to FIG. 9, in which the hidden profiles of the over-center cam 204 and the first flexible part 12 by the cam support 202 are shown in hidden lines and the rotational axis 204*a* is presented by a cross mark. As shown by FIG. 7, when the over-center cam 204 is rotated to a first position (e.g. by rotating the cam lever 206 up), the first flexible part 12 contacts the over-center cam 204 in a first distance d1 to the rotational axis 204*a*. As shown by FIG. 9, when the over-center cam 204 is rotated to a second position (e.g. by rotating the cam lever 206 down), the first flexible part 12 contacts the over-center cam 204 in a second distance d2 to the rotational axis 204*a*. The second distance d2 is larger than the first distance d1. Therefore, the tensile stress of the first flexible part 12 increases as the over-center cam 204 is rotated from the first position to the second position. Similarly, the second tensing mechanism 22 is also operated to increase the tensile stress of the second flexible part 14. Thereby, the base 10 is loaded with higher attachment forces through the tensed flexible parts 12 and 14, which is conducive to more firmly attaching the base 10 onto the seat plate 32. In addition, in the embodiment, when the child booster seat 1 is secured onto the seat plate 32, the lengths of the first and second flexible parts 12 and 14 (or the lengths of the exposed potions thereof out of the base 10) are fixed; that is, the distances between the bottom frame 102 and the two opposite edges 32*a* and 32*b* are fixed. This feature is also conducive to the firm attachment of the child booster seat 1 onto the seat plate 32.

Furthermore, in the embodiment, the increase in the tensile stress is achieved by the over-center cam 204 bending the first flexible part 12 more. In other words, the over-center cam 204 elongates the path of the first flexible part 12 from the 3-bar adjuster 242 to the first attachment part 16 by rotating from the first position to the second position. Therefore, the first flexible part 12 is elongated when the over-center cam 204 is rotated from the first position to the second position. In addition, in the embodiment, the first flexible part 12 is pushed toward the first side wall 1022 by the over-center cam 204 for increasing the tensile stress; however, the invention is not limited thereto. For example, if the over-center cam 204 is disposed between the first side wall 1022 and the first flexible part 12, the first flexible part 12 can be pushed outward for increasing the tensile stress.

Figure 10:
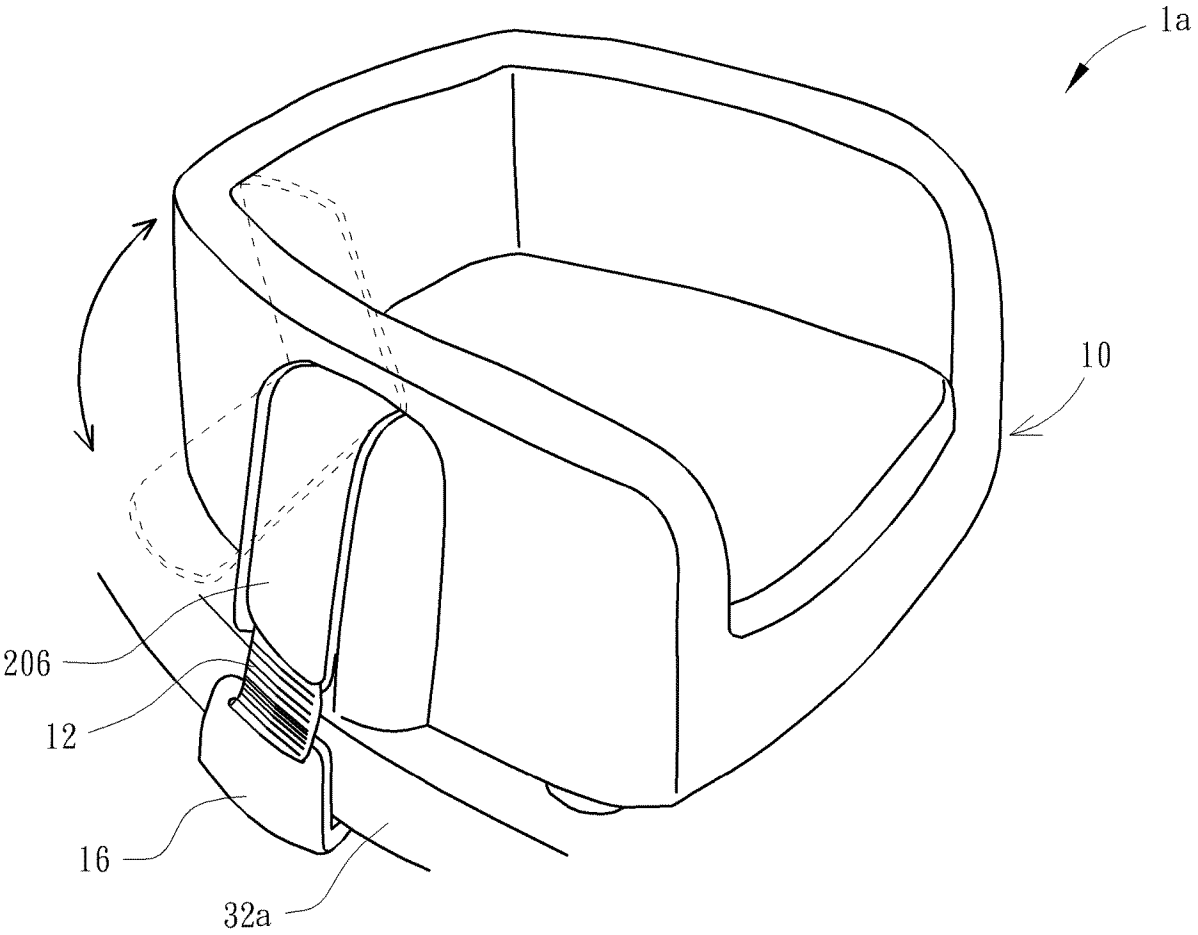
FIG. 10 is a schematic diagram illustrating a child booster seat with an aesthetic appearance of another embodiment according to the invention.

When the child booster seat 1 is to be detached from the adult chair 3, the caregiver can open the seat plate 104 for access to the accommodating space 106. After rotating the adjuster support 244 downward, the caregiver can loosen the first flexible part 12 by moving the first flexible part 12 relative to the 3-bar adjuster 242, so that the first attachment part 16 can be detached from the seat plate 32. Therein, it is helpful to the detachment of the first attachment part 16 to make the over-center cam 204 pivot up. The above is also applied to the second attachment part 18 to be detached from the seat plate 32. After the first and second attachment parts 16 and 18 are detached from the seat plate 32, the caregiver can move the child booster seat 1 from the adult chair 3. Further, the caregiver can use the first length adjusting device 24 to adjust or shorten the length of the first flexible part 12, so that the first attachment part 16 hooks a lower edge 1022*a* of the first side wall 1022 (as shown by FIG. 1); that is, the first attachment part 16 is operable to hook the lower edge 1022*a* of the first side wall 1022. Similarly, the second attachment part 18 is operable to hook a lower edge 1024*a* of the second side wall 1024. Thereby, the first and second attachment parts 16 and 18 will not swing when the child booster seat 1 is moved, which is also conducive to the storage of the child booster seat 1. Based on the structure of the child booster seat 1, the caregiver can carry the child booster seat 1 by gripping the front side wall 1026 or the rear side wall 1028; the gripping position is indicated in FIG. 1. In addition, in practice, the child booster seat 1 can be aesthetically designed as a child booster seat 1*a* shown by FIG. 10. In the child booster seat 1*a*, the cam lever 206 is designed to be a curved plate. The first attachment part 16 is designed to be a plastic hook. The base 10 is designed to be an injection-molded or blow-molded plastic part. The whole child booster seat 1*a* shows a simple and neat structure.

Figure 11:
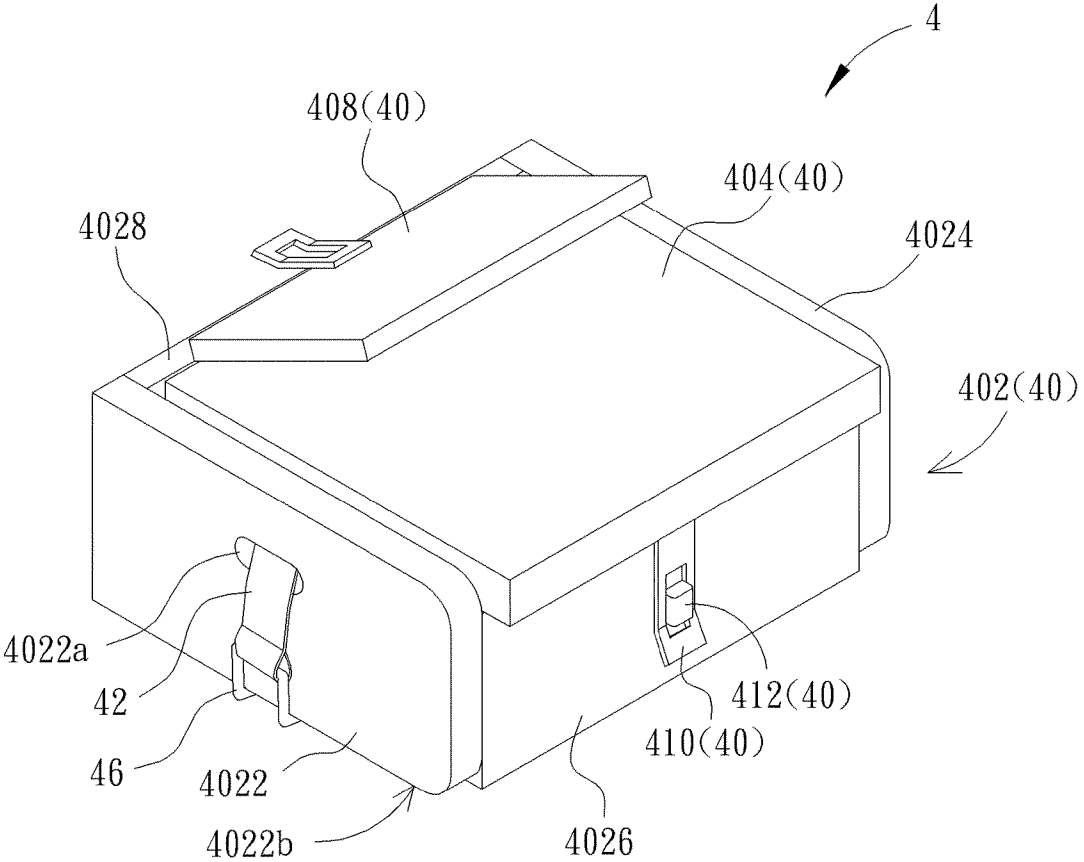
FIG. 11 is a schematic diagram illustrating a child booster seat of another embodiment according to the invention.
Figure 12:
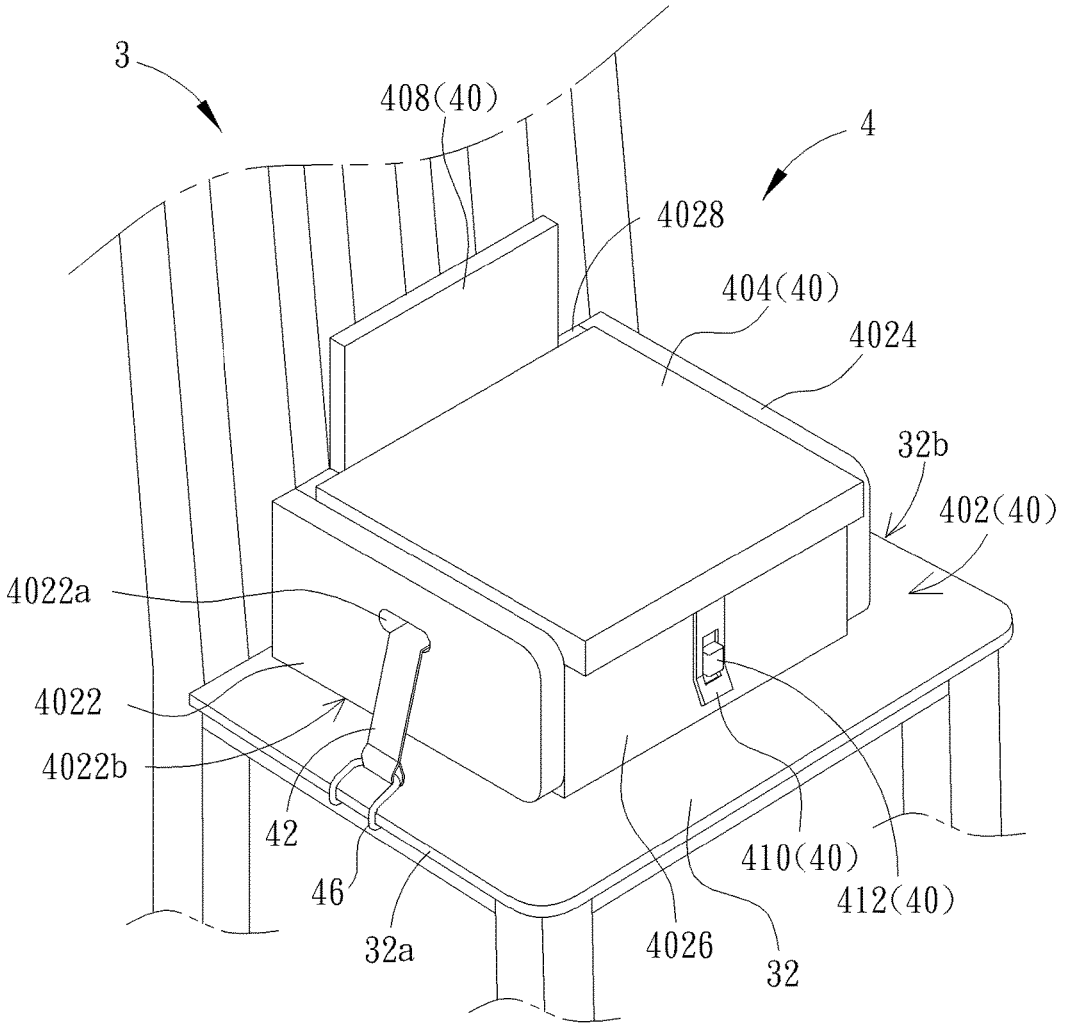
FIG. 12 is a schematic diagram illustrating the child booster seat in FIG. 11, which is secured onto an adult chair.
Figure 13:
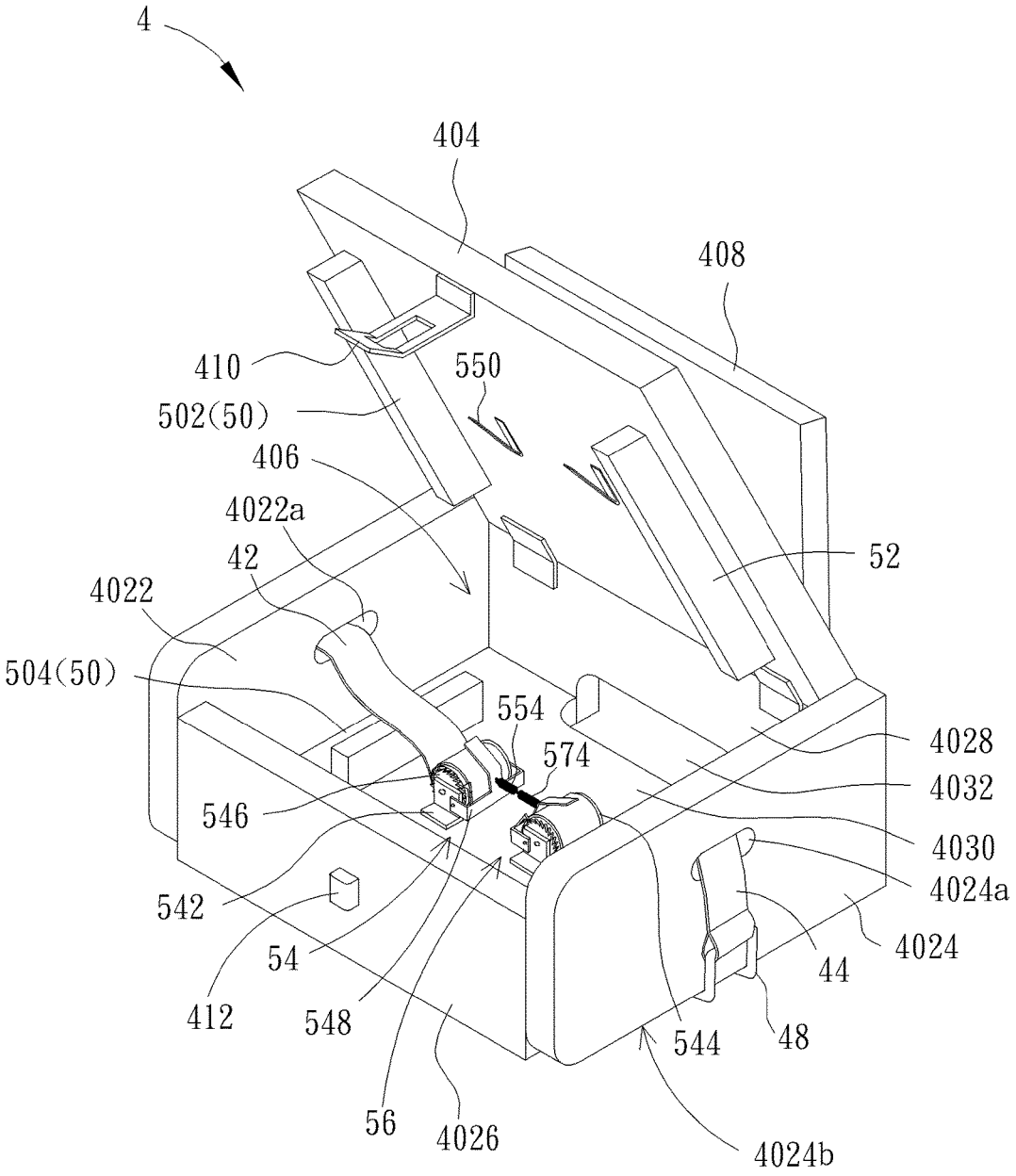
FIG. 13 is a schematic diagram illustrating the child booster seat in FIG. 11, of which a seat plate is rotated up.

Please refer to FIG. 11 and FIG. 13. A child booster seat 4 of another embodiment according to the invention includes a base 40, a flexible connecting member (including a first flexible part 42 and a second flexible part 44), a first attachment part 46, a second attachment part 48, and a mechanism (including a first tensing mechanism 50 and a second tensing mechanism 52). The first flexible part 42 and the second flexible part 44 are attached to the base 40. The first attachment part 46 is disposed outside the base 40 and attached to one end of the first flexible part 42. The second attachment part 48 is disposed opposite to the first attachment part 46 outside the base 40 and attached to one end of the second flexible part 44. The first tensing mechanism 50 is disposed on the base 40 for tensing the first flexible part 42. The second tensing mechanism 52 is disposed on the base 40 for tensing the second flexible part 44. As shown by FIG. 12, when the child booster seat 4 is secured on the adult chair 3, the first attachment part 46 and the second attachment part 48 are attached to the opposite edges 32*a* and 32*b* of the seat plate 32 of the adult chair 3, and the first tensing mechanism 50 and the second tensing mechanism 52 are operated to tense the first flexible part 42 and the second flexible part 44 respectively. Therein, the first and second tensing mechanisms 50 and 52 increase the tensile stresses of the first and second flexible parts 42 and 44 by taking up sufficient slack of the first and second flexible parts 42 and 44 respectively, so that the first and second flexible parts 42 and 44 can be tighter. In addition, the attaching mechanism of the child booster seat 4 to the adult chair 3 is similar to that of the child booster seat 1 in logic, so for other descriptions about the components of the child booster seat 4, please also refer to the relevant descriptions of the components with the same names in the child booster seat 1.

Figure 15:
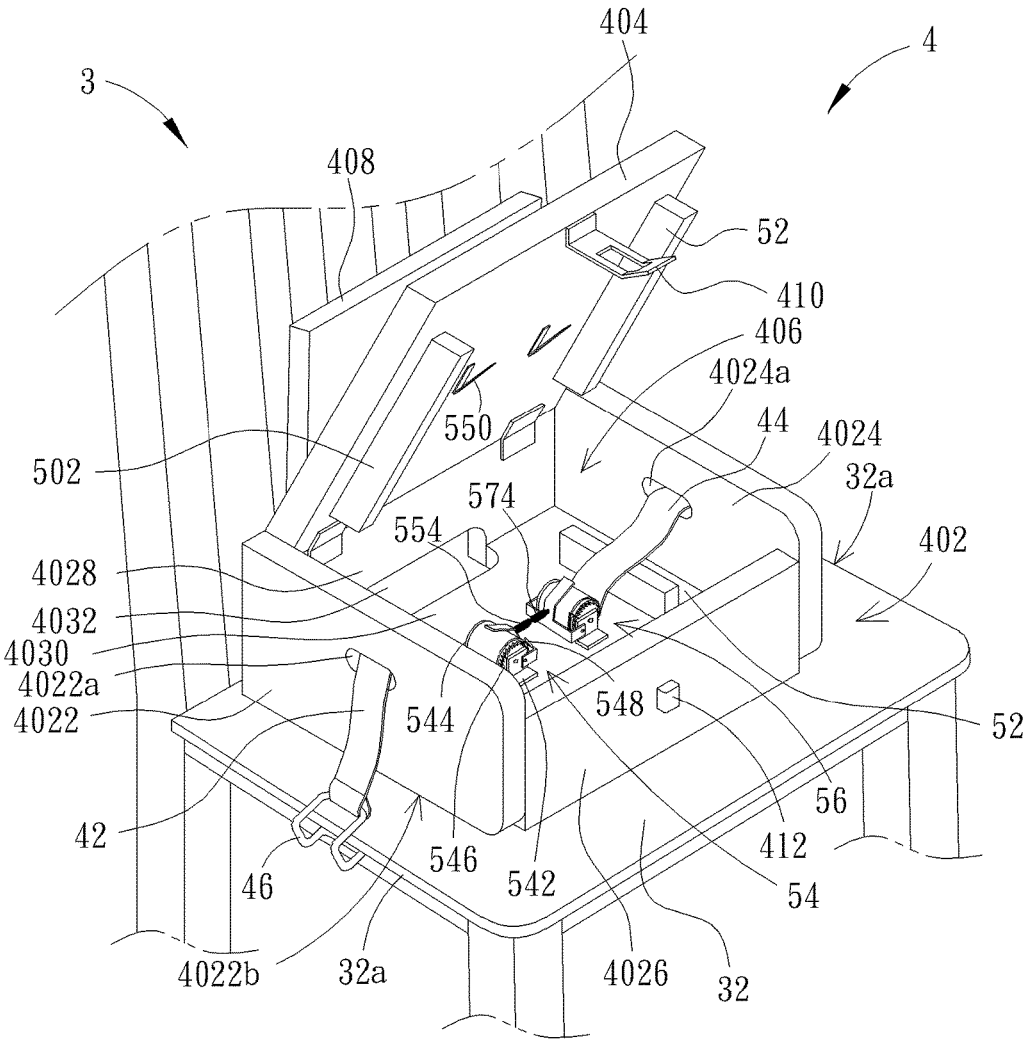
FIG. 15 is a schematic diagram illustrating the child booster seat, of which two attachment parts are pulled and attached to two opposite edges of the seat plate of the adult chair.

In more detail for the embodiment, the child booster seat 4 is structurally symmetric for simplification of description; therefore, the first flexible part 42, the first attachment part 46, and the first tensing mechanism 50 are identical to the second flexible part 44, the second attachment part 48, and the second tensing mechanism 52 respectively, and descriptions for the corresponding components can refer to each other. Please also refer to FIG. 15 to FIG. 17. In the embodiment, the base 40 includes a bottom frame 402 and a seat plate 404 pivotally connected to the bottom frame 402. When the seat plate 404 is rotated down, the bottom frame 402 and the seat plate 404 form an accommodating space 406. The bottom frame 402 includes a first side wall 4022, a second side wall 4024, a front side wall 4026, and a rear side wall 4028, which are connected to form a rectangle frame. The bottom frame 402 also includes a bottom wall 4030 connected to the rectangle frame. The seat plate 404 is pivotally connected to the first and second side walls 4022 and 4024. The base 40 further includes a seat back 408 pivotally connected to the rear side wall 4028. When the seat back 408 is rotated up and the seat plate 404 is rotated down, the seat plate 404 is also supported by the front side wall 4026 so that a child sitting on the seat plate 404 can recline against the seat back 408. The first flexible part 42 is a flexible webbing strap. The first attachment part 46 is sewn to one end of the first flexible part 42. The first flexible part 42 passes through a hole 4022*a* of the first side wall 4022 and is attached to bottom frame 402 through a first length adjusting device 54 disposed in the accommodating space 406; therefore, the first flexible part 42 extends out the base 40 from the hole 4022*a* of the first side wall 4022. Similarly, the second flexible part 44 passes through a hole 4024*a* of the second side wall 4024 and is attached to bottom frame 402 through a second length adjusting device 56 disposed in the accommodating space 406; therefore, the second flexible part 44 extends out the base 40 from the hole 4024*a* of the second side wall 4024. In the embodiment, the first and second length adjusting devices 54 and 56 are identical; however, the invention is not limited thereto.

Figure 14:
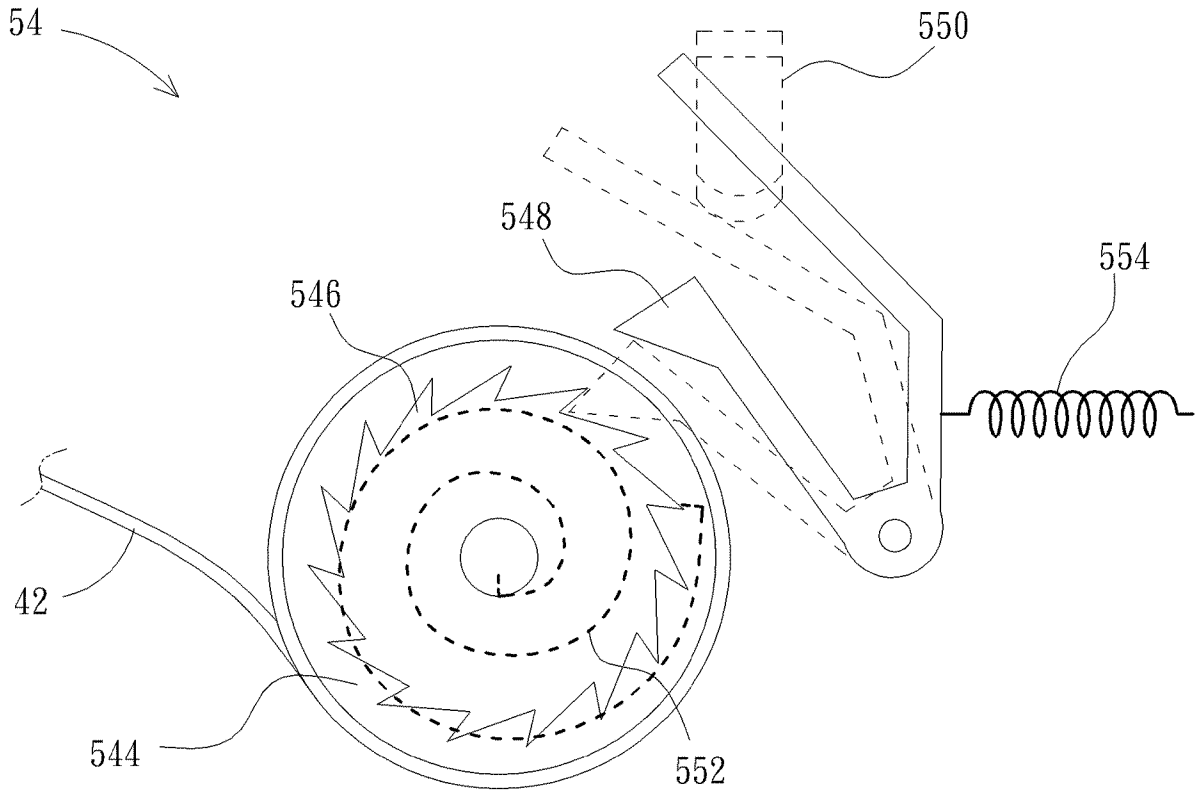
FIG. 14 is a schematic diagram illustrating the operation logic of a first length adjusting device of the child booster seat in a side viewpoint.

The first length adjusting device 54 can adjust an effective length of the first flexible part 42, i.e. the length of a portion of the first flexible part 42 which is involved in attaching the base 40 onto the adult chair 3, so that the first length adjusting device 54 is operable to shorten a length of the first flexible part 42 from the first length adjusting device 54 to the first attachment part 46. The first length adjusting device 54 includes a device frame 542, a winding shaft 544, a ratchet 546, a pawl 548, and a locking tab 550. The device frame 542 is fixed on the bottom wall 4030 of the bottom frame 402 in the accommodating space 406. The winding shaft 544 is pivotally connected to the device frame 542. The ratchet 546 is connected to the winding shaft 544. The pawl 548 is pivotally connected to the device frame 542. The locking tab 550 is disposed on the bottom surface of the seat plate 404 corresponding to the pawl 548, so that when the seat plate 404 pivots toward the bottom frame 402, the locking tab 550 contacts the pawl 548. The first flexible part 42 wraps around the winding shaft 544. As shown by FIG. 14 which illustrates the operation logic of the first length adjusting device 54, in which the device frame 542 is not shown, when the pawl 548 engages with the ratchet 546, the winding shaft 544 is prevented from clockwise rotating, such that the first flexible part 42 cannot be pulled from the first length adjusting device 54 further. In other words, when the pawl 548 disengages from the ratchet 546, the winding shaft 544 can be rotated freely. In the embodiment, the first length adjusting device 54 includes a retraction spring 552 (shown by a bold dashed spiral in FIG. 14) e.g. a torsion spring connected to and between the device frame 542 and the winding shaft 544 so that the winding shaft 544 has a tendency to rotate counterclockwise to wind the first flexible part 42.

Furthermore, the pawl 548 is also connected to a restoration spring 554, so that the pawl 548 is disengaged from the ratchet 546 by the restoration spring 554 when the pawl 548 is free of contact with the locking tab 550. In the embodiment, the restoration spring 554 is but not limited to a coil spring. The restoration spring 554 is also connected to another restoration spring 574 for the second length adjusting device 56; in practice, the restoration springs 554 and 574 can be structurally integrated by a single spring with its two ends connected to the first and second length adjusting devices 54 and 56 respectively, without being connected to the bottom wall 4030. However, the invention is not limited thereto. For example, the restoration springs 554 and 574 are connected to the bottom wall 4030 individually. Both cases can keep the pawl 548 disengaged from the ratchet 546 when the pawl 548 is free of contact with the locking tab 550. In addition, in the embodiment, the locking tab 550 is provided in a resilient cantilever or a spring structure, e.g. a metal strip with one end fixed on the seat plate 404, so that there exists a pressing buffer of the locking tab 550 pressing the pawl 548, which enhances the stability and reliability of the engagement and disengagement of the pawl 548 with the ratchet 546.

Therefore, when the seat plate 404 pivots toward the bottom frame 402, the locking tab 550 drives the pawl 548 to engage with the ratchet 546 so that the first flexible part 42 is prevented from further being pulled out from the first length adjusting device 54 (or the winding shaft 544). When the pawl 548 is disengaged from the ratchet 546, the winding shaft 544 is allowed to wind or release the first flexible part 42. Thereby, the length of the first flexible part 42 from the winding shaft 544 of the first length adjusting device 54 to the first attachment part 46 can be adjusted by operating the first length adjusting device 54.

Figure 16:
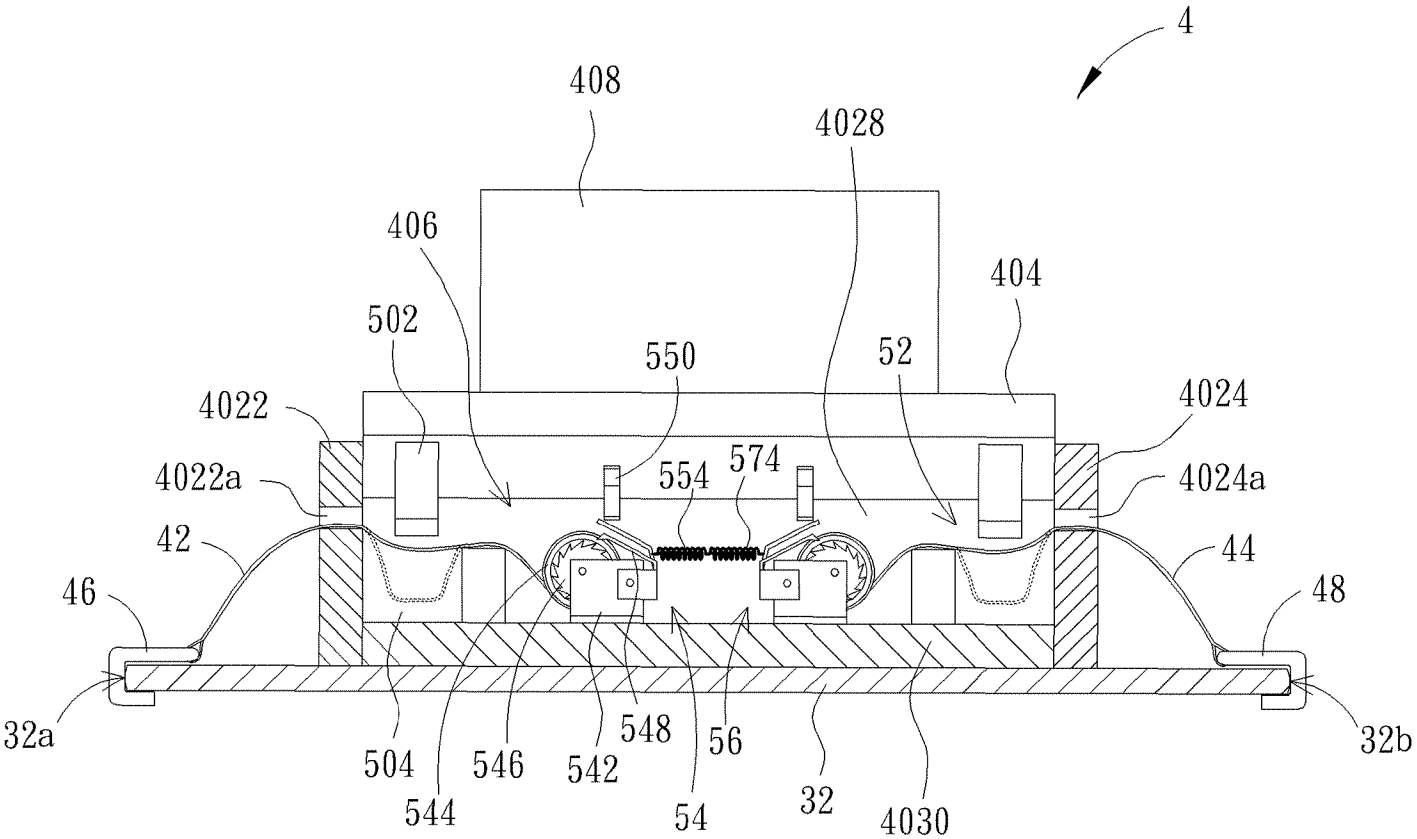
FIG. 16 is a schematic diagram illustrating a first tensing mechanism of the child booster seat.
Figure 17:
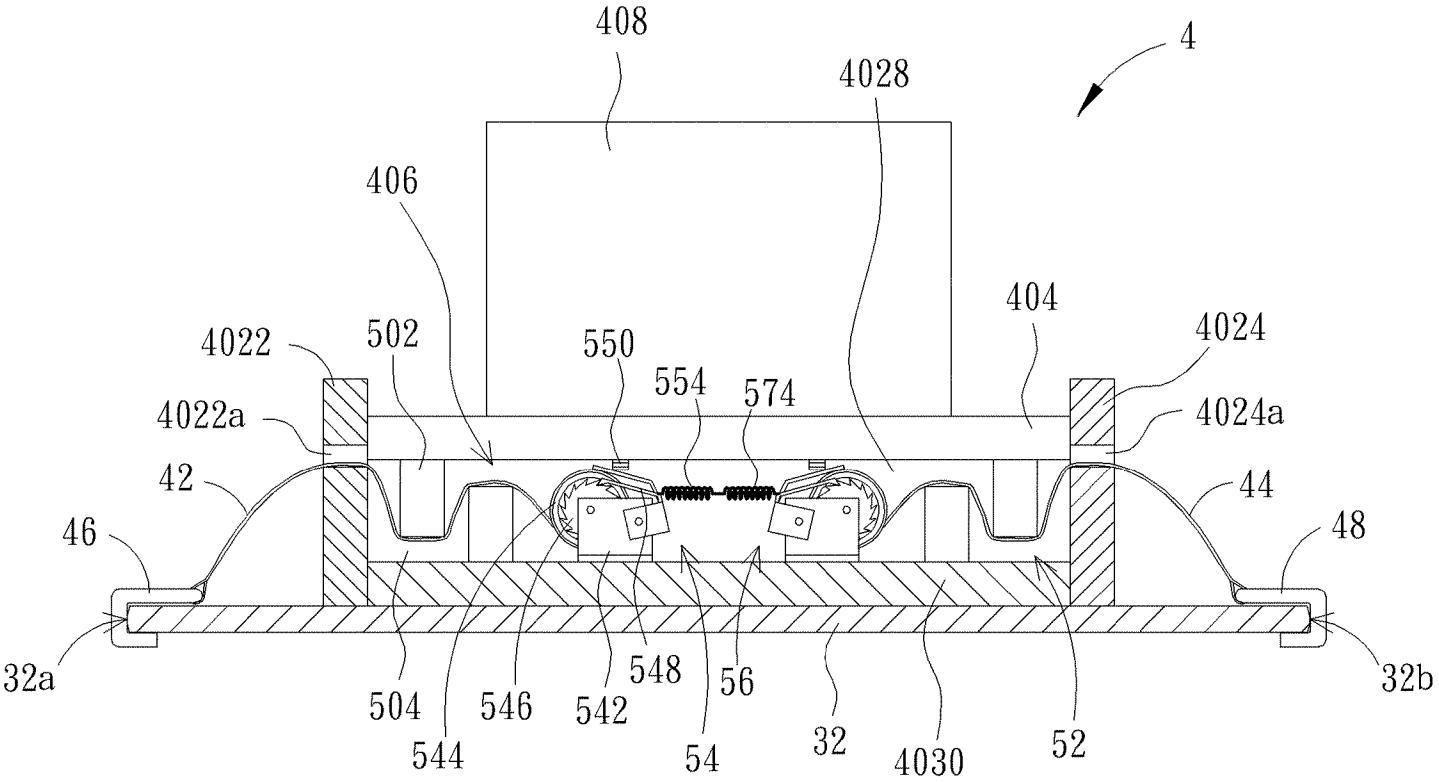
FIG. 17 is a schematic diagram illustrating an engagement status of a protruding part and a slot of the first tensing mechanism.

The first tensing mechanism 50 is disposed in the accommodating space 406 and includes a protruding part 502 and a slot 504 adapted to the protruding part 502. The protruding part 502 is disposed on the bottom surface of the seat plate 404 while the slot 504 is disposed on the bottom frame 402. In the embodiment, the slot 504 is formed by the first side wall 4022 and a part protruding from the bottom wall 4030; however, the invention is not limited thereto. For example, the slot 504 can be formed by two protruding parts from the bottom wall 4030, or be a U-shaped part (i.e. having a recess taken as the slot 504). The protruding part 502 and the slot 504 are located at two opposite sides of the first flexible part 42. When the seat plate 404 rotates close to the bottom frame 402, the protruding part 502 is inserted into the slot 504 so that the first flexible part 42 passes between the protruding part 502 and the slot 504 (as schematically shown by FIG. 17 and indicated by dashed lines in FIG. 16); that is, the protruding part 502 and a portion of the first flexible part 42 are inserted into the slot 504. In other words, the protruding part 502 forces the first flexible part 42 to bend, which leads to an increment of tensile stress of the first flexible part 42 in principle. In addition, in practice, the protruding part 502 can be alternatively disposed on the bottom frame 402 while the slot 504 can be disposed on the bottom surface of the seat plate 404. The above tensing effect also can be achieved.

When the child booster seat 4 is to be secured to the adult chair 3, the caregiver can place the base 40 on the seat plate 32 of the adult chair 3. Then, the caregiver can make the seat plate 404 of the base 40 pivot upward for access to the accommodating space 406. At the moment, the pawl 548 is free of contact with the locking tab 550, so the winding shaft 544 is allowed to rotate. Then, when applying a force to the winding shaft 544 for overcoming elastic force produced by the retraction spring 552, e.g. by drawing the first flexible part 42 outward, the caregiver then can pull the first attachment part 46 outward for adjust the length of the first flexible part 42 out of the winding shaft 544 so that the caregiver can make the first attachment part 46 hook the edge 32*a* of the seat plate 32. Therein, because the winding shaft 544 is spring-loaded, the winding shaft 544 will automatically wind the first flexible part 42 so that the slack of the first flexible part 42, if exists, will be eliminated or at least reduced greatly. By the similar way, the caregiver also can make the second attachment part 48 hook the edge 32*b* of the seat plate 32.

Afterward, the caregiver can rotate the seat plate 104 down so that the protruding part 502 presses the first flexible part 42 and inserts into the slot 504 so that the first flexible part 42 is bent and passes between the protruding part 502 and the slot 504 (as shown by FIG. 17). Therein, as shown by FIG. 16, the locking tab 550 contacts pawl 548 before the protruding part 502 is completely inserted the slot 504, so the insertion of the protruding part 502 into the slot 504 can increase the tensile stress of the first flexible part 42. Thereby, the base 40 is loaded with higher attachment forces through the tensed flexible parts 42 and 44, which is conducive to more firmly attaching the base 40 onto the seat plate 32. In practice, the increment of the tensile stress of the first flexible part 42 can be determined according to the insertion length of the protruding part 502 into the slot 504 and the position of the protruding part 502 relative to the slot 504 when the pawl 548 is effectively engaged with the ratchet 546. One skilled in the art of the invention can obtain a required tensile stress easily obtained by trial and error. In addition, in the embodiment, the seat plate 404 is firmly fixed on the bottom frame 402 by a snap locking mechanism, which includes a snap catch 410, disposed on the seat plate 404, and a protruding post 412, disposed on the front side wall 4026 (as shown by FIG. 12). Thereby, the tensed flexible parts 42 and 44 can be maintained stably. At the moment, the child booster seat 4 is secured onto the seat plate 32 of the adult chair 3 (as shown by FIG. 12), and a child can sit on the child booster seat 4 safely.

Figure 18:
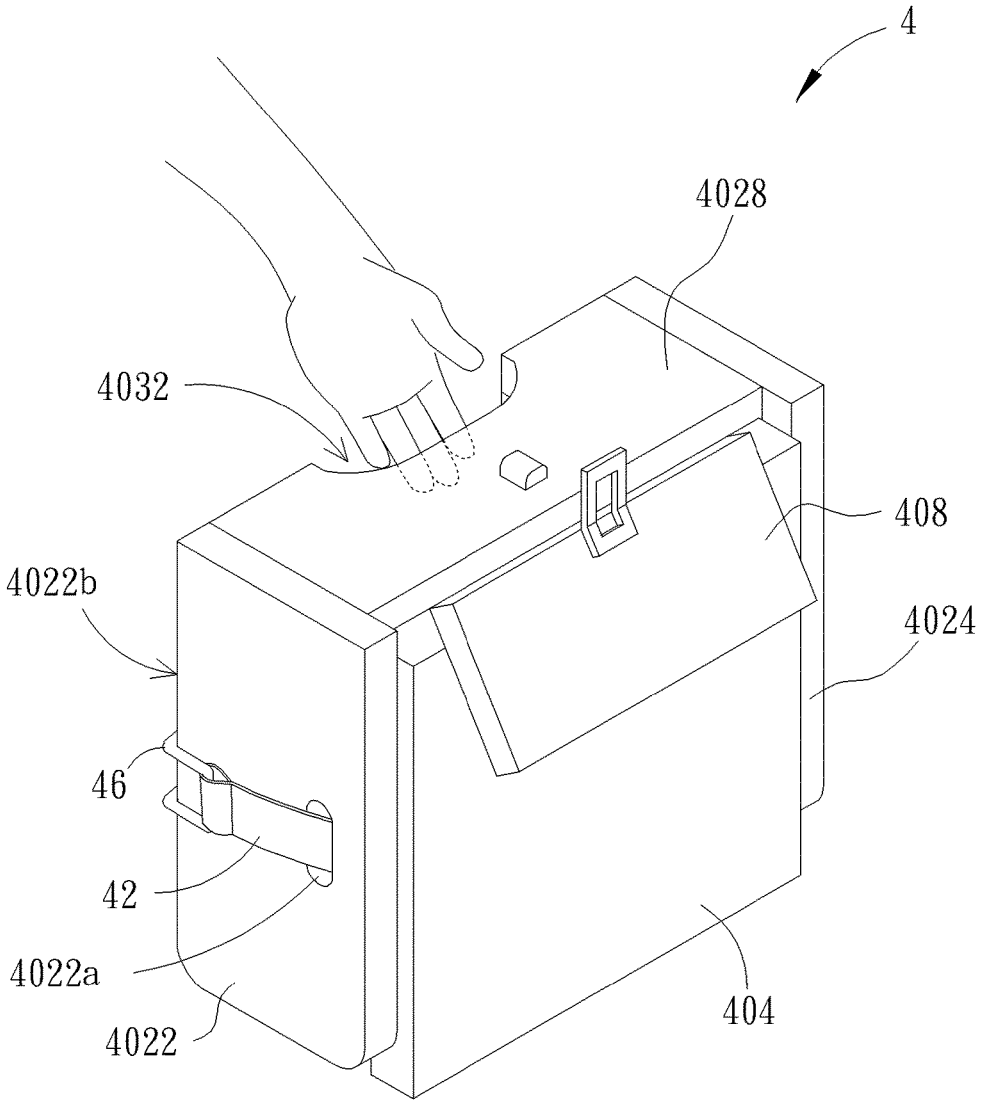
FIG. 18 is a schematic diagram illustrating the child booster seat, which is carried by a hand.

When the child booster seat 4 is to be detached from the adult chair 3, the caregiver can perform the above operations in a reverse order, e.g. opening the seat plate 404 and then disengaging the first and second attachment parts 46 and 48 from the seat plate 32. Further, the caregiver can use the first and second length adjusting devices 54 and 56 to wind the first and second flexible parts 42 and 44 as much as possible so that only the first and second attachment parts 46 and 48 left outside the base 40, or use the first and second length adjusting devices 54 and 56 to adjust the lengths of the first and second flexible parts 42 and 44 so that the first and second attachment parts 46 and 48 just hook lower edges 4022*b* and 4024*b* of the first and second side walls 4022 and 4024 respectively (as shown by FIG. 11). For both cases, the first and second attachment parts 46 and 48 will not swing when the child booster seat 4 is moved, which is also conducive to the storage of the child booster seat 4. In addition, in the embodiment, in the base 40, there is a slot 4032 formed where the rear side wall 4028 and bottom wall 4030 are connected (as shown by FIG. 13). When the child booster seat 4 is folded (i.e. the seat back 408 and the seat plate 404 are rotated stacking on the bottom frame 402, the caregiver can carry the child booster seat 4 by gripping the rear side wall 4028 through the slot 4032, as shown by FIG. 18.

Figure 19:
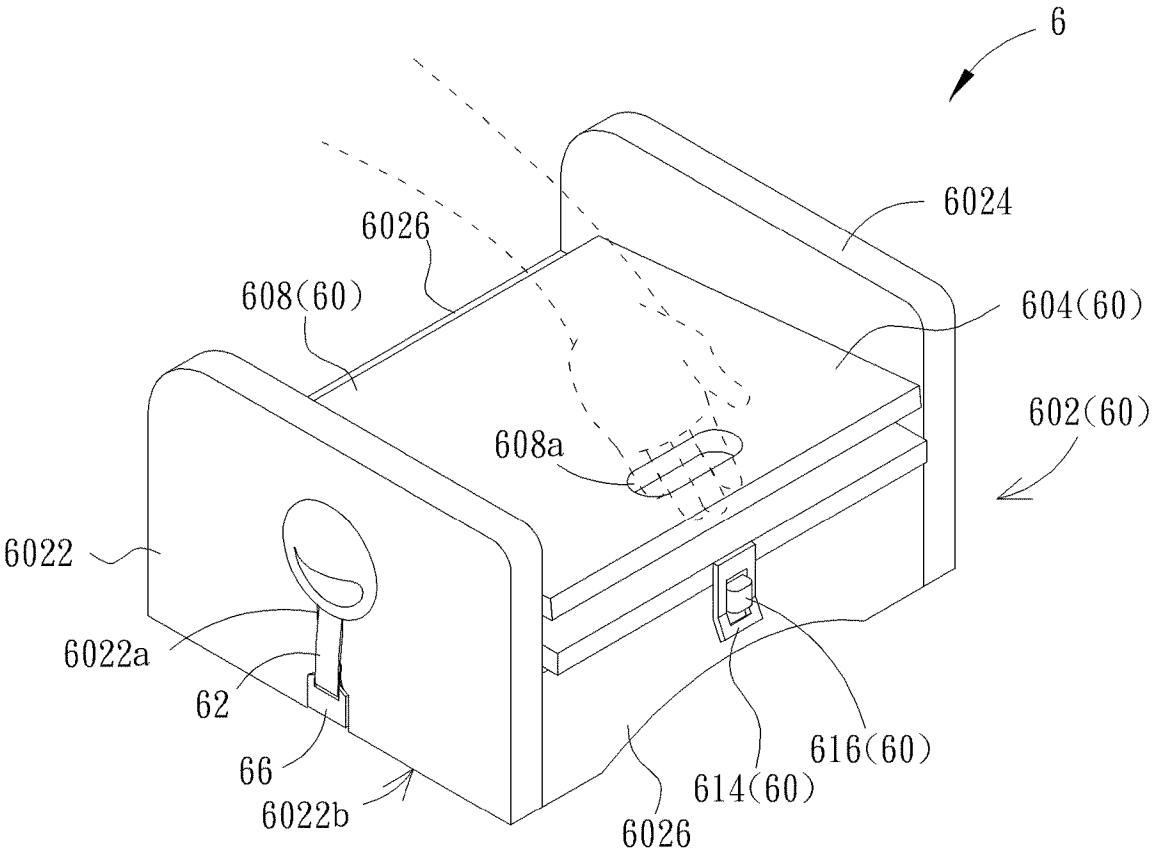
FIG. 19 is a schematic diagram illustrating a child booster seat of another embodiment according to the invention.
Figure 20:
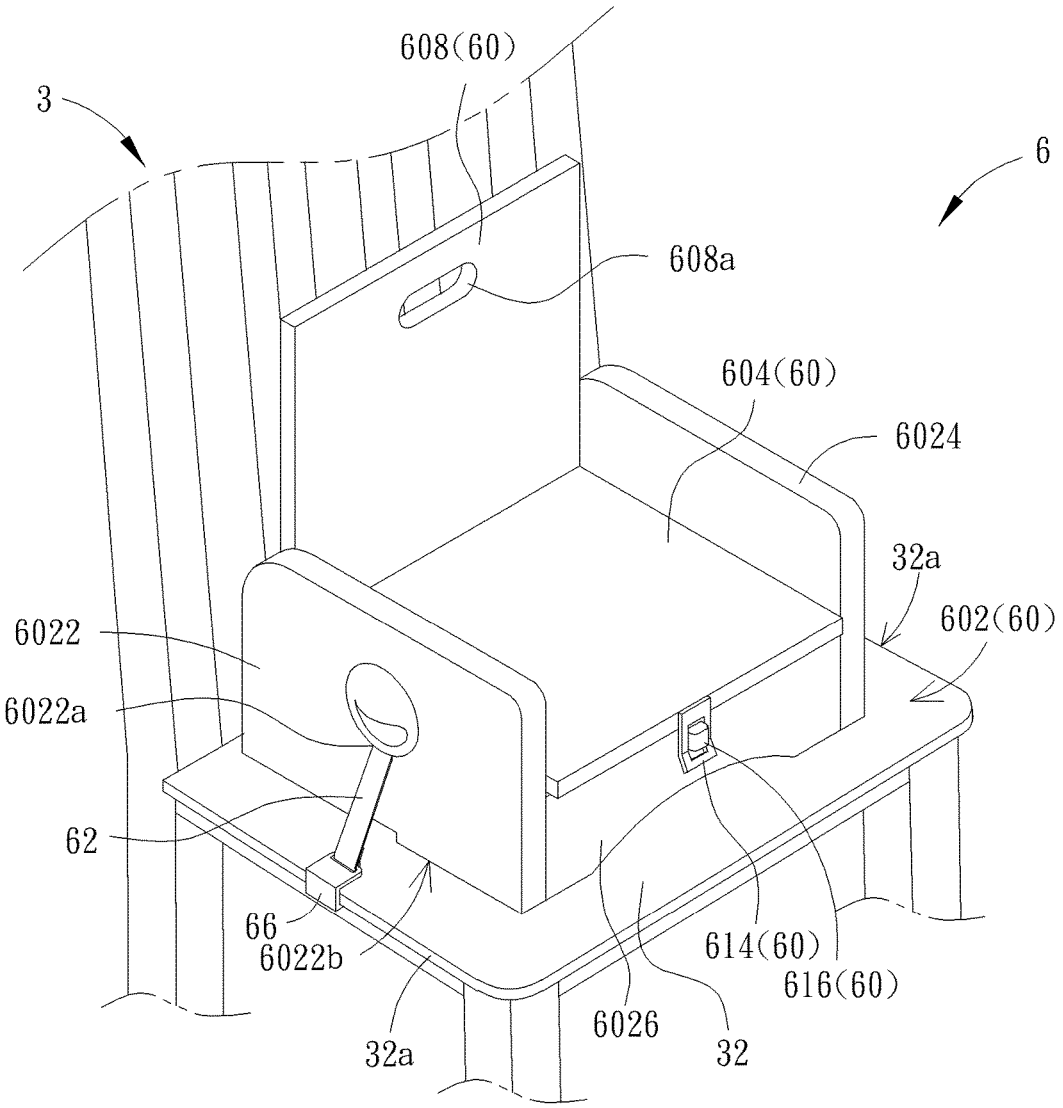
FIG. 20 is a schematic diagram illustrating the child booster seat in FIG. 19, which is secured onto an adult chair.
Figure 21:
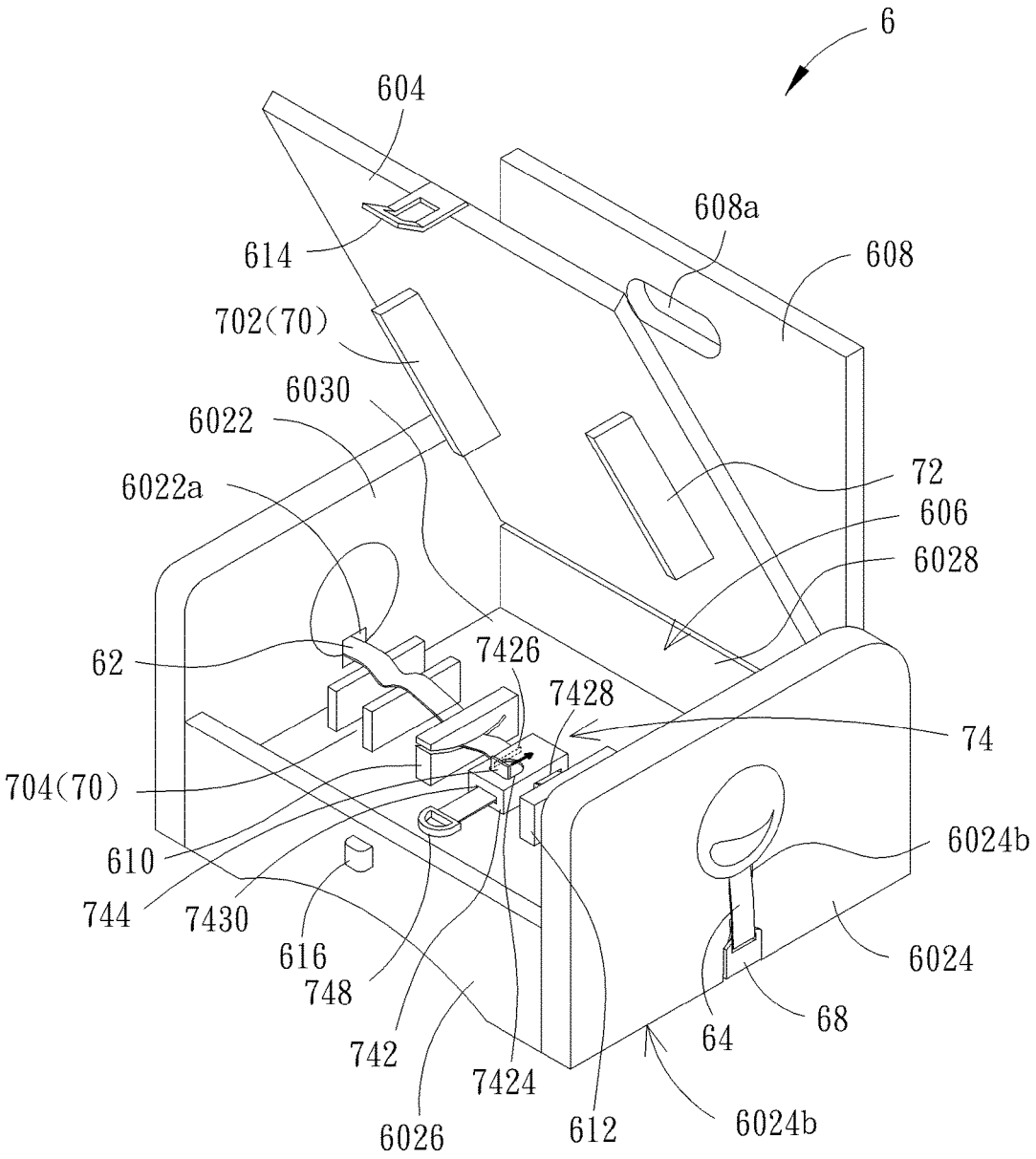
FIG. 21 is a schematic diagram illustrating the child booster seat in FIG. 19, of which a seat plate is rotated up.

Please refer to FIG. 19 and FIG. 21. A child booster seat 6 of another embodiment according to the invention includes a base 60, a flexible connecting member (including a first flexible part 62 and a second flexible part 64), a first attachment part 66, a second attachment part 68, and a mechanism (including a first tensing mechanism 70 and a second tensing mechanism 72). The first flexible part 62 and the second flexible part 64 are attached to the base 60. The first attachment part 66 is disposed outside the base 60 and attached to one end of the first flexible part 62. The second attachment part 68 is disposed opposite to the first attachment part 66 outside the base 60 and attached to one end of the second flexible part 64. The first tensing mechanism 70 is disposed on the base 60 for tensing the first flexible part 62. The second tensing mechanism 72 is disposed on the base 60 for tensing the second flexible part 64. As shown by FIG. 20, when the child booster seat 6 is secured on the adult chair 3, the first attachment part 66 and the second attachment part 68 are attached to the opposite edges 32*a* and 32*b* of the seat plate 32 of the adult chair 3, and the first tensing mechanism 70 and the second tensing mechanism 72 are operated to tense the first flexible part 62 and the second flexible part 64 respectively. Therein, the first and second tensing mechanisms 70 and 72 increase the tensile stresses of the first and second flexible parts 62 and 64 by bending the first and second flexible parts 62 and 64 respectively, so that the first and second flexible part 62 and 64 can be tighter. In addition, the attaching mechanism of the child booster seat 6 to the adult chair 3 is similar to that of the child booster seat 4 in logic, so for other descriptions about the components of the child booster seat 6, please also refer to the relevant descriptions of the components with the same names in the child booster seat 4.

In more detail for the embodiment, the child booster seat 6 is structurally symmetric for simplification of description; therefore, the first flexible part 62, the first attachment part 66, and the first tensing mechanism 70 are identical to the second flexible part 64, the second attachment part 68, and the second tensing mechanism 72 respectively, and descriptions for the corresponding components can refer to each other. Please also refer to FIG. 22 to FIG. 24. In the embodiment, the base 60 includes a bottom frame 602 and a seat plate 604 pivotally connected to the bottom frame 602. When the seat plate 604 is rotated down, the bottom frame 602 and the seat plate 604 form an accommodating space 606. The bottom frame 602 includes a first side wall 6022, a second side wall 6024, a front side wall 6026, and a rear side wall 6028, which are connected to form a rectangle frame. The bottom frame 602 also includes a bottom plate 6030 connected to the first side wall 6022 and the second side wall 6024. The seat plate 604 is pivotally connected to the first and second side walls 6022 and 6024. The base 60 further includes a seat back 608 also pivotally connected to the first and second side walls 6022 and 6024 above the seat plate 604. When the seat back 608 is rotated up and the seat plate 604 is rotated down, the seat plate 604 is also supported by the front side wall 6026 so that a child sitting on the seat plate 604 can recline against the seat back 608. The first flexible part 62 is a flexible webbing strap. The first attachment part 66 is sewn to one end of the first flexible part 62. The first flexible part 62 passes through a hole 6022*a* of the first side wall 6022 and is attached a length adjusting device 74 disposed in the accommodating space 606; the second flexible part 64 passes through a hole 6024*a* of the second side wall 6024 and is attached to the length adjusting device 74. In other words, the first and second flexible parts 62 and 64 are connected by the length adjusting device 74 and as a whole pass through the base 60. In logic, the first and second flexible parts 62 and 64 are attached to the base 60 through the length adjusting device 74. Furthermore, in the embodiment, the length adjusting device 74 remains inside the base 60 (or in the accommodating space 606), so the first and second flexible parts 62 and 64 are kept attached to the base 60. Therefore, the first flexible part 62 extends out the base 60 from the hole 6022*a* of the first side wall 6022, and the second flexible part 64 extends out the base 60 from the hole 6024*a* of the second side wall 6024.

The length adjusting device 74 can adjust an effective length of the first flexible part 62, i.e. the length of a portion of the first flexible part 62 which is involved in attaching the base 60 onto the adult chair 3, so that the length adjusting device 74 is operable to shorten a length of the first flexible part 62 from the length adjusting device 74 to the first attachment part 66. Similarly, the length adjusting device 74 also can adjust an effective length of the second flexible part 64, so that the length adjusting device 74 is also operable to shorten a length of the second flexible part 64 from the length adjusting device 74 to the second attachment part 68.

Figure 22:
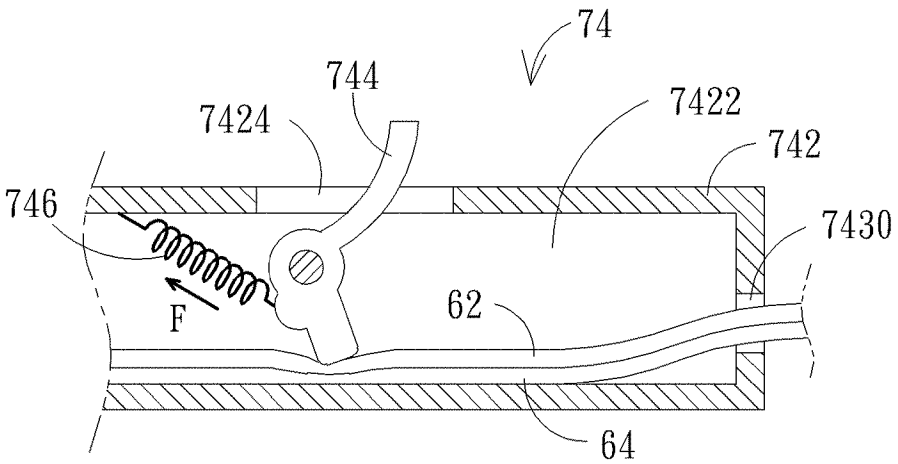
FIG. 22 is a schematic diagram illustrating the operation logic of a length adjusting device of the child booster seat in a side viewpoint.

The length adjusting device 74 includes a device casing 742, a pressing lever 744, and a restoration spring 746. The device casing 742 has a room 7422, an opening 7424, a first inlet 7426 (of which the profile is shown by dashed lines in FIG. 21), a second inlet 7428, and an outlet 7430. The pressing lever 744 is pivotally connected to the device casing 742 in the room 7422 and protrudes out of the device casing 742 through the opening 7424. The first flexible part 62 passes through the room 7422 from the first inlet 7426 to the outlet 7430. The second flexible part 64 passes through the room 7422 from the second inlet 7428 to the outlet 7430. The restoration spring 746 is connected to the device casing 742 and the pressing lever 744. The first flexible part 62 and the second flexible part 64 pass between the pressing lever 744 and a side wall of the device casing 742 in the room 7422. The restoration spring 746 applies a force F (represented by an arrow in FIG. 22 which illustrates the operation logic of the length adjusting device 74) to the pressing lever 744 so that the first flexible part 62 and the second flexible part 64 are clamped between the pressing lever 744 and the device casing 742. In practice, the restoration spring 746 can be but not limited thereto a coil spring, a torsion spring or any capable of offering a restoration force to the pressing lever 744 so that the pressing lever 744 tends to return to its original position (as shown by FIG. 22) and clamp the first and second flexible parts 62 and 64. In the embodiment, in the view point of FIG. 22, the restoration spring 746 makes the pressing lever 744 have a tendency to rotate clockwise to keep pressing the first and second flexible parts 62 and 64.

Furthermore, when the first flexible part 62 or the second flexible part 64 has a tendency to move outward from the first and second inlets 7426 and 7428 respectively, the friction between the first flexible part 62, the second flexible part 64, the device casing 742, and the pressing lever 744 will draw the pressing lever 744 to rotate clockwise more, which leads to a jam or locking to the first and second flexible parts 62 and 64 so that the first and second flexible parts 62 and 64 are fixed more firmly by the length adjusting device 74. When the caregiver pushes the pressing lever 744 to rotate counterclockwise, the pressing lever 744 will not press or just slightly touch the first and second flexible parts 62 and 64 so that the first and second flexible parts 62 and 64 are released and movable. Afterward, when the caregiver releases the pressing lever 744, the pressing lever 744 rotates clockwise to press the first and second flexible parts 62 and 64 again under the force F by the restoration spring 746. Furthermore, when the first flexible part 62 or the second flexible part 64 is to move outward from the outlet 7430, the friction between the first flexible part 62, the second flexible part 64, the device casing 742, and the pressing lever 744 will draw the pressing lever 744 to rotate counterclockwise, which makes the pressing lever 744 just slightly touch the first and second flexible parts 62 and 64 so that the first and second flexible parts 62 and 64 are released and movable. In other words, the first and second flexible parts 62 and 64 are not allowed to move outward from the first and second inlets 7426 and 7428 until the caregiver unlocks the pressing lever 744 by the caregiver, but allowed to move outward from the outlet 7430 without unlocking the pressing lever 744 by the caregiver.

In the embodiment, the length adjusting device 74 includes a ring 748 (e.g. a D-ring or a tab). The first flexible part 62 and the second flexible part 64 extend out the device casing 742 from the outlet 7430 to be attached to the ring 748. Therefore, the caregiver can simultaneously shorten the lengths of the first and second flexible parts 62 and 64 from the length adjusting device 74 to the first and second attachment parts 66 and 68 respectively. In practice, it is practicable to connecting ends of the first and second flexible parts 62 and 64 without the ring 748, so that the caregiver also can simultaneously shorten the lengths of the first and second flexible parts 62 and 64. However, the invention is not limited thereto. For example, the ends of first and second flexible parts 62 and 64 from the outlet 7430 just dangle. The caregiver can adjust the lengths of the first and second flexible parts 62 and 64 individually. In addition, in practice, the length adjusting device 74 also can be fixed on the bottom plate 6030, which enhances the stability of attachment of the first and second flexible parts 62 and 64 to the base 60.

The first tensing mechanism 70 is disposed in the accommodating space 606 and includes a protruding part 702 and a slot 704 adapted to the protruding part 702. The protruding part 702 is disposed on the bottom surface of the seat plate 604 while the slot 704 is disposed on the bottom frame 602. In the embodiment, the slot 704 is formed by two protruding parts from the bottom plate 6030. The protruding part 702 and the slot 704 are located at two opposite sides of the first flexible part 62. When the seat plate 604 rotates close to the bottom frame 602, the protruding part 702 is inserted into the slot 704 so that the first flexible part 62 passes between the protruding part 702 and the slot 704 (as schematically shown by FIG. 24 and indicated by dashed lines in FIG. 23). In other words, the protruding part 702 forces the first flexible part 62 to bend, which leads to an increment of tensile stress of the first flexible part 62 in principle. In addition, in practice, the protruding part 702 can be alternatively disposed on the bottom frame 602 while the slot 704 can be disposed on the bottom surface of the seat plate 604. The above tensing effect also can be achieved.

Furthermore, in the embodiment, the base 60 comprises a first guiding slot 610 and a second guiding slot 612. The first guiding slot 610 is disposed between the first tensing mechanism 70 and the length adjusting device 74 on the bottom plate 6030 of the bottom frame 602 in the accommodating space 606. The second guiding slot 612 is disposed between the second tensing mechanism 72 and the length adjusting device 74 on the bottom plate 6030 in the accommodating space 606. The first flexible part 62 passes through the first guiding slot 610. The second flexible part 64 passes through the second guiding slot 612. Thereby, the first and second guiding slots 610 and 612 are conducive to the stability of the first and second flexible parts 62 and 64 in the bottom frame 602.

When the child booster seat 6 is to be secured to the adult chair 3, the caregiver can place the base 60 on the seat plate 32 of the adult chair 3. Then, the caregiver can make the seat plate 604 of the base 60 pivot upward for access to the accommodating space 606. The caregiver can loosen the first and second flexible parts 62 and 64 by rotating (or pushing) the pressing lever 744 toward the rear side wall 6028 (indicated by an arrow in shown by FIG. 21) and drawing the first and second flexible parts 62 and 64. Next, the caregiver can detach the first and second attachment parts 66 and 68 from lower edges 6022*b* and 6024*b* of the first and second side wall 6022 and 6024 respectively and then make the first and second attachment parts 66 and 68 hook the edges 32*a* and 32*b* of the seat plate 32 respectively (referring to FIG. 23). In practice, the caregiver can operate the length adjusting device 74 again for obtaining proper lengths or slack of the first and second flexible parts 62 and 64 for the following tensing execution by the first and second tensing mechanisms 70 and 72.

Afterward, the caregiver can rotate the seat plate 604 down so that the protruding part 702 presses the first flexible part 62 and inserts into the slot 704 so that the first flexible part 62 is bent and passes between the protruding part 702 and the slot 704 (as shown by FIG. 24). Therein, in logic, the engagement of the protruding part 702 and the slot 704 elongates the path for the first flexible part 62 to pass through the first tensing mechanism 70, which increases the tensile stress of the first flexible part 62. Similarly, the tensile stress of the second flexible part 64 is increased by the second tensing mechanism 72 in the same way. Thereby, the base 60 is loaded with higher attachment forces through the tensed flexible parts 62 and 64, which is conducive to more firmly attaching the base 60 onto the seat plate 32. In practice, the increment of the tensile stress of the first flexible part 62 can be determined according to the insertion length of the protruding part 702 into the slot 704 and the slack of the first flexible part 62 before the engagement of the protruding part 702 and the slot 704. One skilled in the art of the invention can obtain a required tensile stress easily obtained by trial and error. In addition, in the embodiment, the seat plate 604 is firmly fixed on the bottom frame 602 by a snap locking mechanism, which includes a snap catch 614, disposed on the seat plate 604, and a protruding post 616, disposed on the front side wall 6026 (as shown by FIG. 20). Thereby, the tensed flexible parts 62 and 64 can be maintained stably. At the moment, the child booster seat 6 is secured onto the seat plate 32 of the adult chair 3 (as shown by FIG. 20), and a child can sit on the child booster seat 6 safely.

When the child booster seat 6 is to be detached from the adult chair 3, the caregiver can perform the above operations in a reverse order, e.g. opening the seat plate 604 and then disengaging the first and second attachment parts 66 and 68 from the seat plate 32. Therein, if the slack of the first and second flexible parts 62 and 64 after the seat plate 604 is rotated up is still not enough for detaching the first and second attachment parts 66 and 68 from the seat plate 32, the caregiver can operate the length adjusting device 74 again for more slack. Further, the caregiver can use the length adjusting device 74 to adjust the lengths of the first and second flexible parts 62 and 64 so that the first and second attachment parts 66 and 68 just hook lower edges 6022*b* and 6024*b* of the first and second side walls 6022 and 6024 respectively. Therefore, the first and second attachment parts 66 and 68 will not swing when the child booster seat 6 is moved, which is also conducive to the storage of the child booster seat 6. In addition, in the embodiment, the seat back 608 has a slot 608*a*. When the seat back 608 and the seat plate 604 are rotated stacking on the bottom frame 602, the caregiver can carry the child booster seat 6 through the slot 608*a*, as shown by FIG. 19.

In addition, in practice, the child booster seat 6 can include a connecting part 76 (as shown by a dashed line in FIG. 24) for connecting the first and second attachment parts 66 and 68 after the first and second attachment parts 66 and 68 are attached to the opposite edges 32*a* and 32*b* of the seat plate 32 of the adult chair 3, which makes the attachment of the first and second attachment parts 66 and 68 to the seat plate 32 more stable. In practice, the connecting part 76 can be but not limited thereto a cable with two hooks at its two ends.

Figure 23:
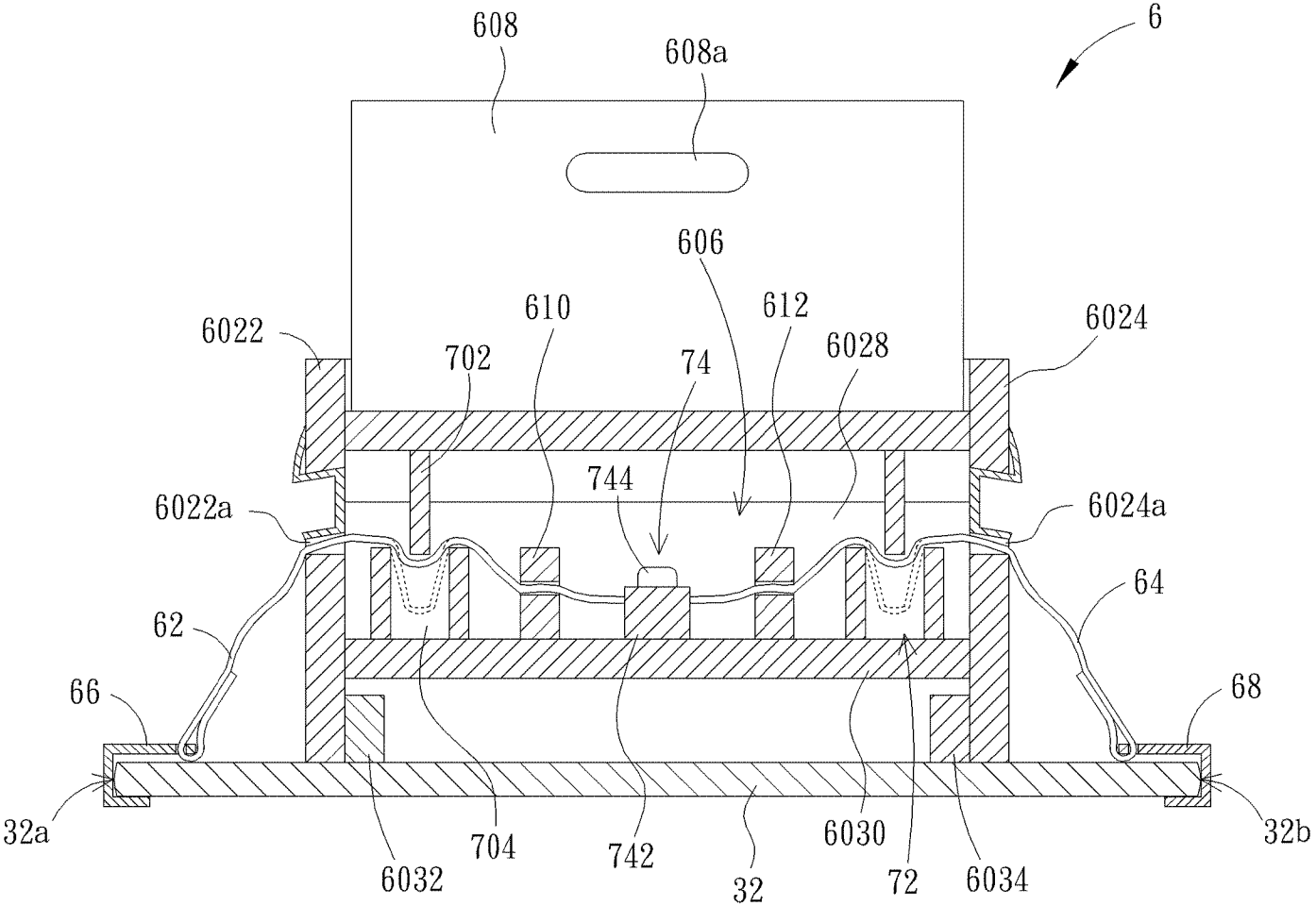
FIG. 23 is a schematic diagram illustrating a first tensing mechanism of the child booster seat.
Figure 24:
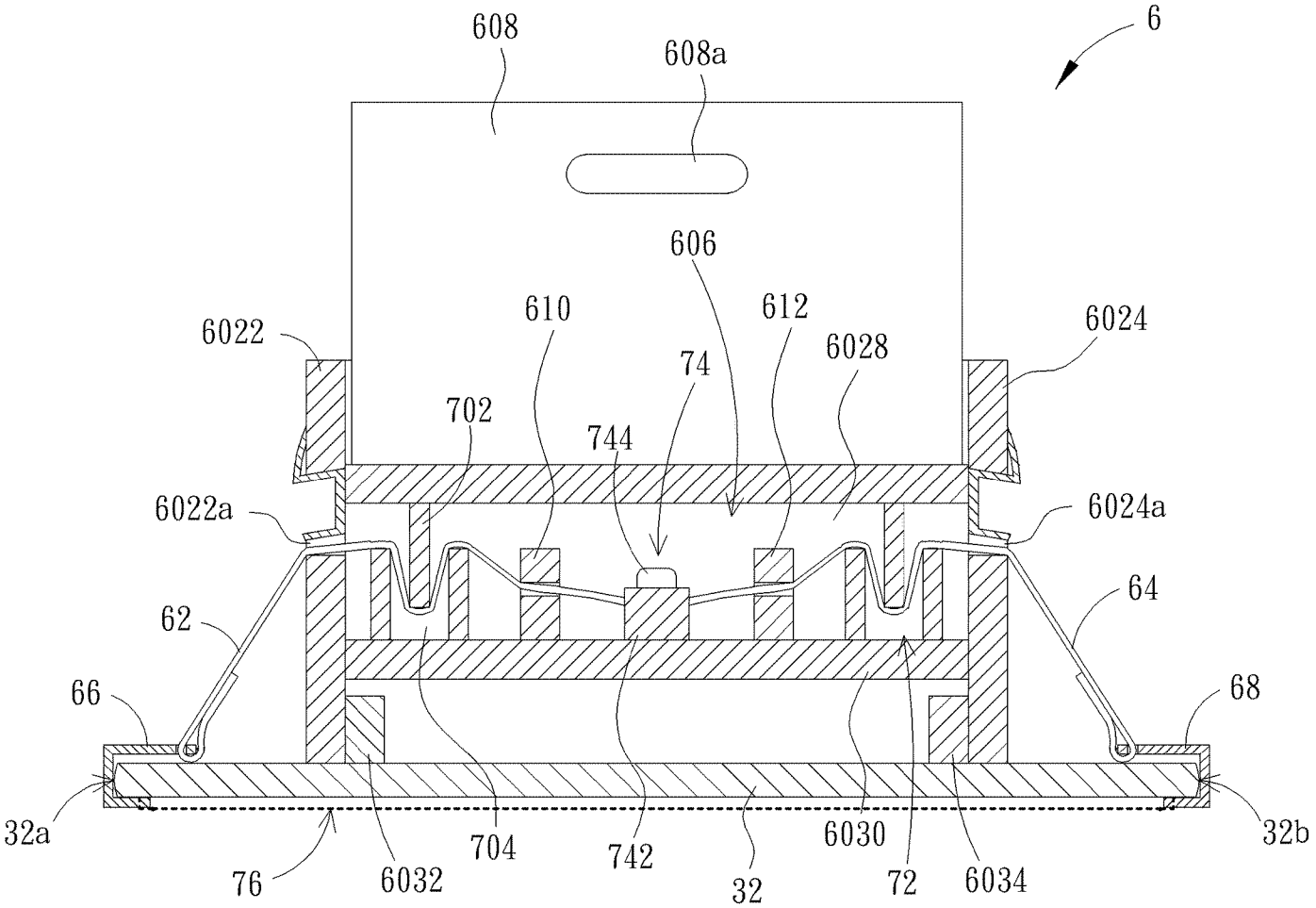
FIG. 24 is a schematic diagram illustrating an engagement status of a protruding part and a slot of the first tensing mechanism.
Figure 25:
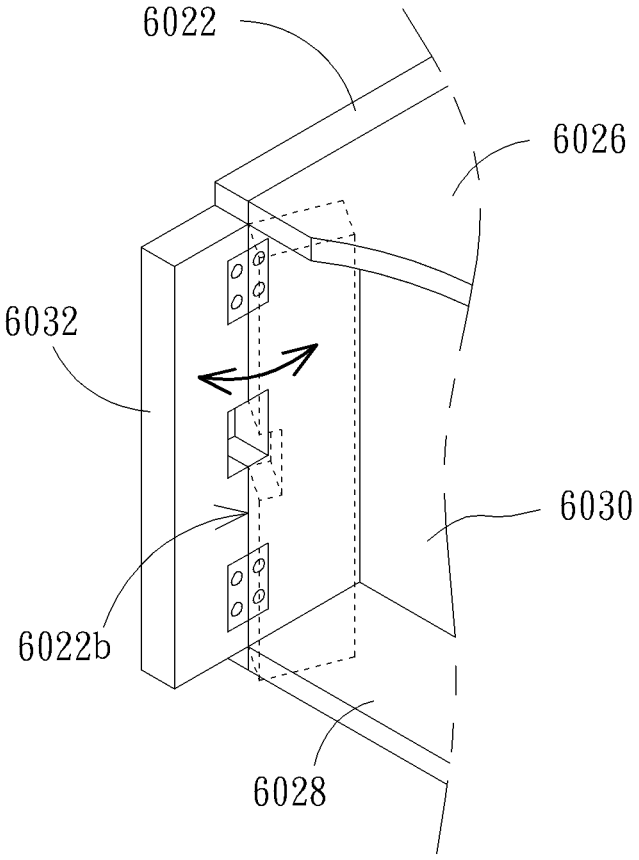
FIG. 25 is a schematic diagram illustrating unfolding extension feet for the child booster seat.

In addition, in the embodiment, as shown by FIG. 25, the bottom frame 602 further includes a first extension foot 6032 and a second extension foot 6034 (referring to FIG. 23). The first extension foot 6032 and the second extension foot 6034 are structurally symmetric. For the structural details of the second extension foot 6034, please refer to those of the first extension foot 6032. The first extension foot 6032 is pivotally connected to the lower edge 6022*b* of the first side wall 6022, e.g. through a hinge; similarly, the second extension foot 6034 is pivotally connected to the lower edge 6024*b* of the second side wall 6024. When the first extension foot 6032 and the second extension foot 6034 are unfolded, the seat plate 604 of the child booster seat 6 can be set higher relative to the seat plate 32 of the adult chair 3. When the first extension foot 6032 and the second extension foot 6034 are not in use, they can be folded into the bottom frame 602 for saving space.

Figure 26:
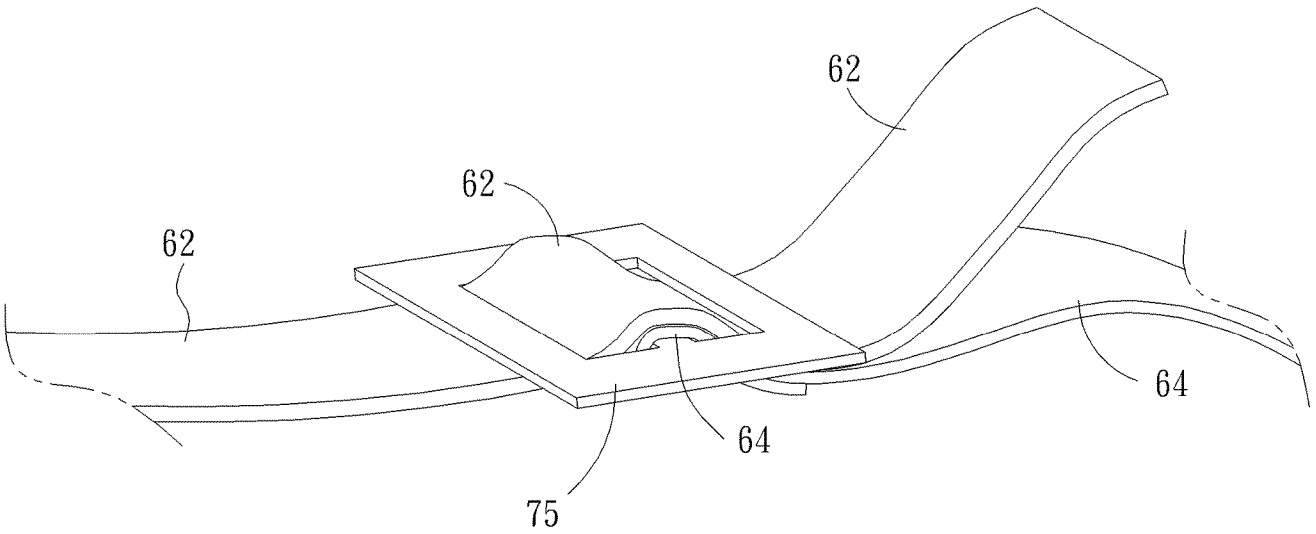
FIG. 26 is a schematic diagram illustrating a length adjusting device for the child booster seat according to another embodiment.

In addition, in the embodiment, the effective lengths of the first and second flexible parts 62 and 64 are adjusted by the length adjusting device 74, which is described in detail above. In practice, the length adjusting device 74 can be replaced with a 3-bar buckle 75, as shown by FIG. 26. The 3-bar buckle 75 is disposed in the accommodating space 606. The middle bar of the 3-bar buckle 75 is sewn to the second flexible part 64. The first flexible part 62 is woven through the 3-bar buckle 75. Thereby, the first and second flexible parts 62 and 64 are connected in the accommodating space 606 by the 3-bar buckle 75, which leads to a linkage relation between the first and second attachment parts 66 and 68. In other words, the lengths of the portions of the first and second flexible parts 62 and 64 exposed out of the base 60 are related. For example, without operating the 3-bar buckle 75, the second attachment part 68 is drawn toward the bottom frame 602 when the first attachment part 66 is pulled away from the bottom frame 602, and vice versa. The 3-bar buckle 75 can be moved relatively to the first flexible part 62 when a side of the 3-bar buckle 75 is lifted. Therefore, the 3-bar buckle 75 is operable to move relatively to the first flexible part 62 to shorten a length of the first flexible part 62 from the 3-bar buckle 75 to the first attachment part 66. The above adjustment in the length of the first flexible part 62 can be used just for an adjustment in the length of the portion of the first flexible part 62 exposed out of the base 60 or for both adjustments in the lengths of the portions of the first and second flexible parts 62 and 64 exposed out of the base 60. That is, the positions of the first and second attachment parts 66 and 68 can be adjusted by the 3-bar buckle 75. In addition, in practice, the 3-bar buckle 75 can be further replaced with other kinds of buckles e.g. those widely used in backpacks, which also can perform the adjustment function as the 3-bar buckle 75 does.

Figure 27:
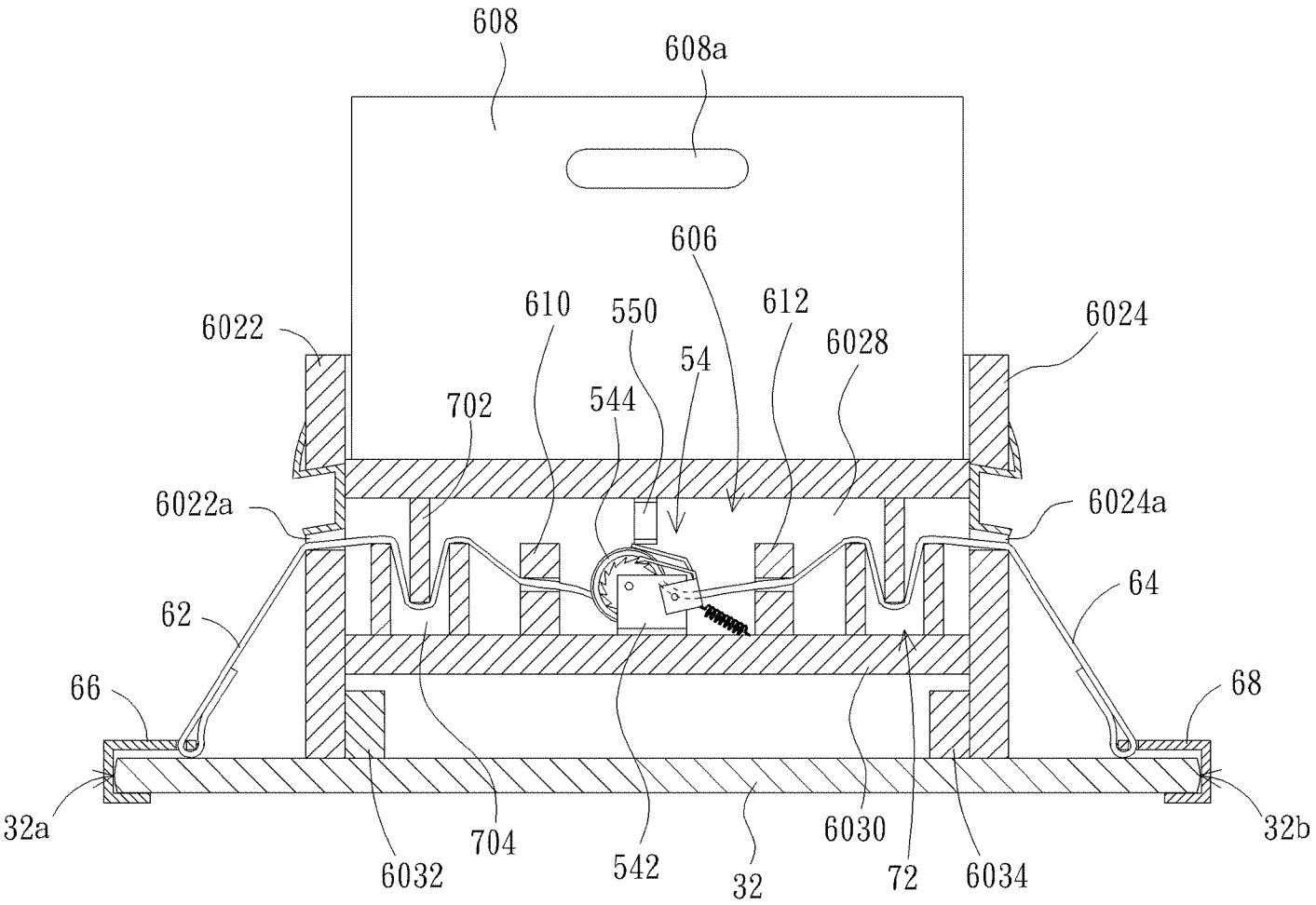
FIG. 27 is a schematic diagram illustrating a child booster seat according to another embodiment.
Figure 28:
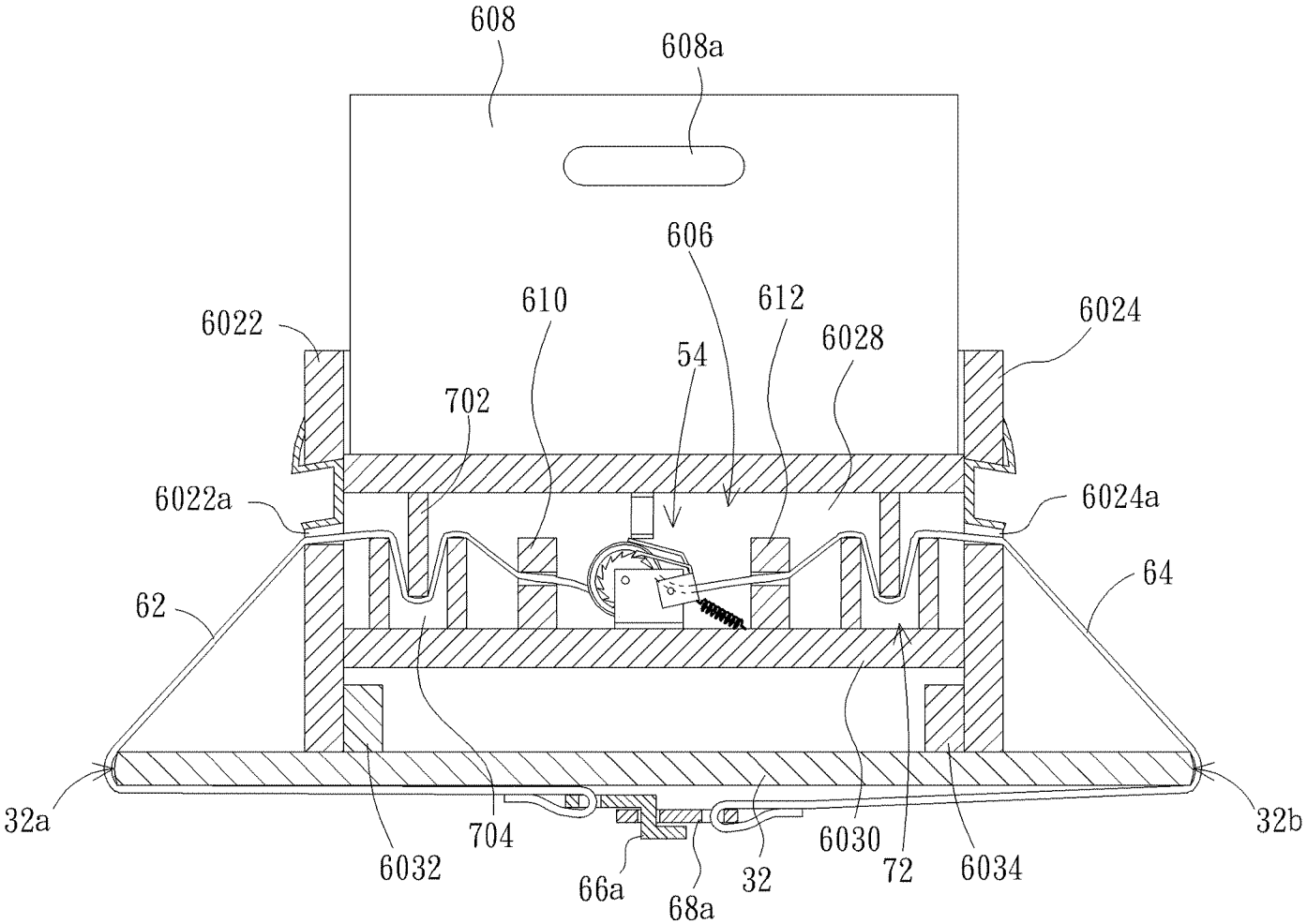
FIG. 28 is a schematic diagram illustrating a child booster seat according to another embodiment, of which the attachment parts are connected with each other under the adult chair.

In addition, in practice, the length adjusting device 74 can be replaced with the length adjusting device 54 (referring to FIG. 14), as shown by FIG. 27. Therein, the first and second flexible parts 62 and 64 wrap around the winding shaft 544 of the length adjusting device 54, so the length adjusting device 54 can adjust the lengths of the first and second flexible parts 62 and 64 simultaneously. In practice, the second flexible part 64 can be just fixed to the device frame 542 of the length adjusting device 54; in this case, the length of the flexible connecting member (including the first and second flexible parts 62 and 64) as a whole is still adjusted by the length adjusting device 54. Further, the first and second attachment parts 66 and 68 can be designed to be capable of engaging with each other, e.g. two attachment parts 66*a* and 68*a*, so that the two attachment parts 66*a* and 68*a* are connected with each other around the bottom of the seat plate 32, as shown by FIG. 28.

In addition, in practice, the components of the above embodiments also can be replaced with the corresponding components in other embodiments as long as the replacement will not induce any structural interference. For example, the first length adjusting device 24 can be replaced with the first length adjusting device 54. For another example, the first tensing mechanism 70 can be replaced with the first tensing mechanism 20 and moves to outside of the bottom frame 602 (to be fixed on the first side wall 6022).

Figure 29:
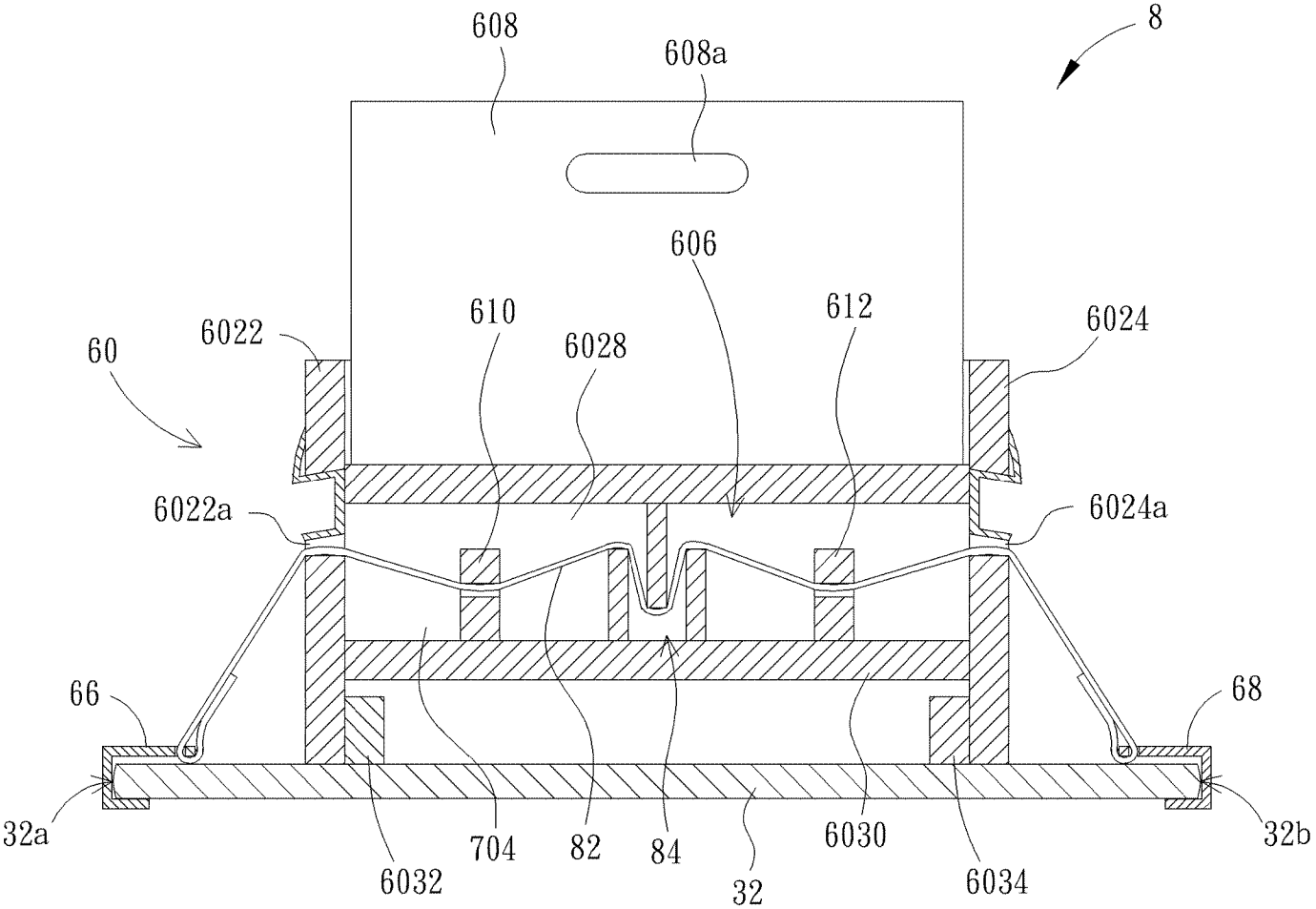
FIG. 29 is a schematic diagram illustrating a child booster seat according to another embodiment.

Furthermore, in the above embodiments, the flexible connecting member is realized by two flexible part (e.g. the first and second flexible parts 12 and 14), but the invention is not limited thereto. As shown by FIG. 29, a child booster seat 8 of an embodiment according to the invention is structurally similar to the child booster seat 6. For other descriptions of the child booster seat 8, please refer to the relevant descriptions of the child booster seat 6 and the relevant figures, which will not be repeated in addition. The child booster seat 8 uses a single flexible part 82 (e.g. a flexible webbing strap) as the flexible connecting member and uses a single tensing mechanism 84 (e.g. the tensing mechanism 70, referring to FIG. 24) for tensing the flexible part 82, by which the exposed portions of the flexible part 82 out of the base 60 can be tighten simultaneously so that the child booster seat 8 also can be attached to the chair 3 firmly. Therein, the first and second attachment parts 66 and 68 are attached to two opposite ends of the flexible part 82 outside the base 60. Similarly, in practice, the components of the above embodiments also can be replaced with the corresponding components in other embodiments as long as the replacement will not induce any structural interference.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A child booster seat, comprising:

a base, having a seat plate and a bottom frame, the seat plate being pivotally connected to the bottom frame, the bottom frame and the seat plate forming an accommodating space;

a flexible connecting member, attached to the base and comprising a first flexible part and a second flexible part;

a first attachment part, attached to an end of the first flexible part;

a second attachment part, disposed opposite to the first attachment part and attached to an end of the second flexible part;

a length adjusting device, disposed in the accommodating space, the first flexible part and the second flexible part being attached to the base through the length adjusting device, the length adjusting device being operable to shorten a length of the first flexible part from the length adjusting device to the first attachment part and a length of the second flexible part from the length adjusting device to the second attachment part; and a mechanism, disposed on the base and comprising a first tensing mechanism and a second tensing mechanism for tensing the first flexible part and the second flexible part respectively;

wherein when the child booster seat is secured on a chair through the first attachment part and the second attachment part, the mechanism is operated to tense the flexible connecting member.

2. The child booster seat of claim 1, wherein the first tensing mechanism comprises a cam support, an over-center cam, and a cam lever, the cam support is fixed on the base, the over-center cam is pivotally connected to the cam support about a rotational axis, the cam lever is connected to the over-center cam, when the over-center cam is rotated to a first position, the first flexible part contacts the over-center cam in a first distance to the rotational axis, when the over-center cam is rotated to a second position, the first flexible part contacts the over-center cam in a second distance to the rotational axis, and the second distance is larger than the first distance.

3. The child booster seat of claim 1, wherein the first tensing mechanism is disposed in the accommodating space and comprises a protruding part and a slot corresponding to the protruding part, one of the protruding part and the slot is disposed on the bottom frame, the other one of the protruding part and the slot is disposed on the seat plate, the protruding part and the slot are located at two opposite sides of the first flexible part, and when the seat plate pivots toward the bottom frame, the protruding part and a portion of the first flexible part are inserted into the slot.

4. The child booster seat of claim 1, wherein the length adjusting device comprises a device casing, a pressing lever, and a restoration spring, the device casing has a room, an opening, a first inlet, a second inlet, and an outlet, the pressing lever is pivotally connected to the device casing in the room and protrudes out of the device casing through the opening, the first flexible part passes through the room from the first inlet to the outlet, the second flexible part passes through the room from the second inlet to the outlet, the restoration spring is connected to the device casing and the pressing lever and applies a force to the pressing lever so that the first flexible part and the second flexible part are clamped between the pressing lever and the device casing.

5. The child booster seat of claim 4, wherein each of the first flexible part and the second flexible part extend out of the device casing from the outlet to be attached to a ring.

6. The child booster seat of claim 1, wherein the base comprises a first guiding slot and a second guiding slot, the first guiding slot is disposed between the first tensing mechanism and the length adjusting device on the bottom frame in the accommodating space, the second guiding slot is disposed between the second tensing mechanism and the length adjusting device on the bottom frame in the accommodating space, the first flexible part passes through the first guiding slot, and the second flexible part passes through the second guiding slot.

7. The child booster seat of claim 1, wherein the base has a first side wall and a second side wall opposite to the first side wall, the first flexible part extends out the base from the first side wall, the second flexible part extends out the base from the second side wall, the first attachment part is operable to hook an edge of the first side wall, and the second attachment part is operable to hook an edge of the second side wall.

8. The child booster seat of claim 7, wherein the base has a first extension foot and a second extension foot, the first extension foot is pivotally connected to the edge of the first side wall, and the second extension foot is pivotally connected to the edge of the second side wall.

9. The child booster seat of claim 1, further comprising a connecting part for connecting the first attachment part and the second attachment part after the first attachment part and the second attachment part are attached to opposite edges of the chair.

10. A child booster seat, comprising:

a base, having a seat plate and a bottom frame, the seat plate being pivotally connected to the bottom frame, the bottom frame and the seat plate forming an accommodating space;

a flexible connecting member, attached to the base and comprising a first flexible part and a second flexible part;

a first attachment part, attached to the first flexible part;

a second attachment part, disposed opposite to the first attachment part and attached to the second flexible part; and a mechanism, disposed on the base and comprising a first tensing mechanism and a second tensing mechanism for tensing the first flexible part and the second flexible part respectively, the first tensing mechanism being disposed in the accommodating space and comprising a protruding part and a slot adapted to the protruding part, one of the protruding part and the slot being disposed on the bottom frame, the other one of the protruding part and the slot being disposed on the seat plate, the protruding part and the slot being located at two opposite sides of the first flexible part, when the seat plate pivots toward the bottom frame, the protruding part and a portion of the first flexible part being inserted into the slot;

wherein when the child booster seat is secured on a chair through the first attachment part and the second attachment part, the mechanism is operated to tense the flexible connecting member.

* * * * *